US010020084B2

(12) United States Patent
Lehnert et al.

(10) Patent No.: US 10,020,084 B2
(45) Date of Patent: Jul. 10, 2018

(54) SYSTEM AND METHOD FOR PROCESSING SPENT NUCLEAR FUEL

(71) Applicant: EnergySolutions, LLC, Salt Lake City, UT (US)

(72) Inventors: Robert A. Lehnert, San Jose, CA (US); Brandon D. Thomas, San Jose, CA (US); Steven E. Sisley, San Jose, CA (US)

(73) Assignee: EnergySolutions, LLC, Salt Lake City, UT (US)

( * ) Notice: Subject to any disclaimer, the term of this patent is extended or adjusted under 35 U.S.C. 154(b) by 1465 days.

(21) Appl. No.: 13/829,084

(22) Filed: Mar. 14, 2013

(65) Prior Publication Data

US 2014/0270043 A1 Sep. 18, 2014

(51) Int. Cl.

| | |
|---|---|
| ***G21C 19/00*** | (2006.01) |
| ***G21F 5/008*** | (2006.01) |
| *G21C 19/40* | (2006.01) |

(52) U.S. Cl.

CPC ..... *G21F 5/008* (2013.01); *G21C 19/40* (2013.01)

(58) Field of Classification Search

CPC . G21F 5/00; G21F 5/005; G21F 5/008; G21F 5/12; G21F 5/14

See application file for complete search history.

(56) References Cited

U.S. PATENT DOCUMENTS

| | | | | |
|---|---|---|---|---|
| 4,272,683 | A | 6/1981 | Baatz et al. | |
| 4,320,847 | A | 3/1982 | Gesser et al. | |
| 4,330,711 | A | 5/1982 | Ahner et al. | |
| 4,336,460 | A | 7/1982 | Best et al. | |
| 4,532,428 | A | 7/1985 | Dyck et al. | |
| 4,569,818 | A | 2/1986 | Popp et al. | |
| 4,579,274 | A | 4/1986 | Anspach et al. | |
| 4,626,380 | A | 12/1986 | Baatz et al. | |
| H617 | H * | 4/1989 | Hertelendy | G21F 5/12 53/330 |
| 5,043,679 | A | 8/1991 | Crowson et al. | |
| 5,438,597 | A * | 8/1995 | Lehnert | G21F 5/008 250/507.1 |
| 5,894,134 | A | 4/1999 | Kissinger | |
| 6,008,428 | A | 12/1999 | Georgii | |

(Continued)

FOREIGN PATENT DOCUMENTS

| | | | |
|---|---|---|---|
| CN | 101019193 | A | 8/2007 |
| DE | 32 26 986 | A1 | 1/1984 |

(Continued)

OTHER PUBLICATIONS

Blue Ribbon Commission on America's Nuclear Future, Report to the Secretary of Energy, Jan. 26, 2012 (180 pp.).

(Continued)

*Primary Examiner* — Marshall P O'Connor
(74) *Attorney, Agent, or Firm* — Holland & Hart LLP

(57) ABSTRACT

A system and method for managing spent nuclear fuel includes a small capacity canister that preferably encloses or encapsulates a single spent nuclear fuel rod assembly but can enclose up to six spent nuclear fuel rod assemblies. The canister is air tight and prevents radioactive material from escaping. The canister is loaded by positioning a single spent nuclear fuel rod assembly in the canister and then closing the canister to make it air tight.

6 Claims, 31 Drawing Sheets

(56) References Cited

U.S. PATENT DOCUMENTS

| | | | | |
|---|---|---|---|---|
| 6,660,972 | B1 | 12/2003 | Georgii | |
| 6,696,695 | B1 | 2/2004 | Georgii | |
| 7,086,133 | B2 | 8/2006 | Reich | |
| 7,498,594 | B2 | 3/2009 | Georgii | |
| 7,781,752 | B2 * | 8/2010 | Chiocca | G21F 5/005 250/505.1 |
| 8,130,895 | B2 * | 3/2012 | Veron | G21C 19/26 250/507.1 |
| 2005/0207525 | A1 | 9/2005 | Singh | |
| 2006/0039524 | A1 | 2/2006 | Feinroth et al. | |
| 2010/0014623 | A1 | 1/2010 | Gauthier et al. | |
| 2010/0230619 | A1 | 9/2010 | Tamaki | |

FOREIGN PATENT DOCUMENTS

| | | | |
|---|---|---|---|
| EP | 1 600 982 | A2 | 11/2005 |
| EP | 2 219 192 | A1 | 8/2010 |
| JP | 9-113687 | | 5/1997 |
| JP | 10-186091 | | 7/1998 |
| JP | 2004-271435 | | 9/2004 |
| WO | WO 95/10837 | | 4/1995 |
| WO | WO 2010/084122 | A1 | 7/2010 |

OTHER PUBLICATIONS

Bridges, et al., Standardized DOE Spent Nuclear Fuel Canister and Transportation System for Shipment to the National Repository, Idaho National Engineering and Environmental Laboratory (INEEL), Waste Management 2001 Conference, Tucson, AZ, Feb. 25, 2001 (14 pp.).

Evaluation of the Technical Basis for Extended Dry Storage and Transportation of Used Nuclear Fuel, United States Nuclear Waste Technical Review Board, Dec. 2010 (145 pp.).

Kawakami, et al., Design of Spent Fuel Transportable Storage Cask, date unknown (see "Date Information" section below for more information) (6 pp.).

Operation and Maintenance of Spent Fuel Storage and Transportation Casks/Containers, International Atomic Energy Agency (IAEA), Jan. 2007 (130 pp.).

Scaglione, et al., Status Report on Integrated Canister Design and Evaluation, Oak Ridge National Laboratory, Sep. 28, 2012 (80 pp.).

Shultis, Radiation Analysis of a Spent-Fuel Storage Cask, College of Engineering, Kansas State University, Manhatta, Kansas, Jan. 2000 (54 pp.).

Transportation and Storage Subcommittee Report to the Full Commission, Blue Ribbon Commission on America's Nuclear Future, Jan. 2012 (94 pp.).

* cited by examiner

SYSTEM AND METHOD FOR PROCESSING SPENT NUCLEAR FUEL

BACKGROUND

The nuclear fuel cycle is the series of industrial processes used to produce electricity from uranium in a nuclear reactor. The nuclear fuel cycle can be described as having three major parts: (1) the "front end" where uranium is mined and processed into fuel for use in a nuclear reactor, (2) the use of the fuel in a reactor, and (3) the "back end" where spent fuel is stored and eventually disposed or reprocessed (if the spent fuel is reprocessed, remaining wastes would be temporarily stored and eventually disposed).

The nuclear fuel cycle begins with the extraction of uranium from ores or other natural sources. Uranium provides the basic fissile material or "fuel" for nearly all nuclear reactors. Extracted uranium consists almost entirely of two isotopes of uranium atoms, mostly uranium-238 (U-238) (99.3%) together with a much smaller fraction (0.7%) of the fissionable isotope uranium-235 or "U-235."

In its natural state, mined uranium is only weakly radioactive meaning that it can be handled without the need for radiation shielding. Before it can be used in a commercial reactor, natural uranium must be purified and enriched to boost the amount of fissionable U-235 present in the fuel. Most of the commercial nuclear power plants in operation today use fuel enriched to a U-235 concentration of anywhere from 3 to 5 percent—a typical figure for fuel used in commercial U.S. reactors is 4 percent.

The enriched uranium is cast into hard pellets and stacked inside long metal tubes or "cladding" to form nuclear fuel rods. The uranium in the pellets is not pure elemental uranium but rather uranium oxide. The fuel rods are bundled into nuclear fuel rod assemblies that are typically about 12 to about 14 feet long. The core of a typical light-water commercial nuclear power reactor in the U.S. contains roughly about 200 to about 500 nuclear fuel rod assemblies, totaling approximately 100 metric tons of uranium oxide.

Inside the reactor, the enriched uranium sustains a series of controlled nuclear reactions that collectively liberate substantial quantities of energy. The energy is converted to steam and used to drive turbines that generate electricity. Meanwhile, the fission process inside the reactor creates new elements or "fission products," and gives rise to some heavier elements, collectively known as "transuranics," which may take part in further reactions (among the most important is plutonium-239).

The preponderant reactor type currently used in the majority of commercial nuclear power plants is the light water reactor (LWR). There are also several other reactor types in commercial use such as the heavy water reactor (HWR), gas cooled reactor (GCR), boiling water cooled graphite moderated pressure tube type of reactor (RBMK), etc.

Nuclear fuel remains in a commercial power reactor for about four to six years, after which it can no longer efficiently produce energy and is considered used or spent. The spent fuel removed from a reactor is thermally hot and emits a great deal of radiation. Upon removal from the reactor, each spent nuclear fuel rod assembly emits enough radiation to deliver a fatal radiation dose in minutes to someone in the immediate vicinity who is not adequately shielded.

The spent nuclear fuel rod assemblies are transferred to a deep, water-filled pool and stored in a rack. Wet storage keeps the spent fuel cool and protects the workers from the radiation. Ideally, spent fuel is kept in the pool for at least five years, although spent fuel at many U.S. reactor sites has been in pool storage for several decades.

After the fuel has cooled sufficiently in wet storage, it can be transferred to dry storage. Dry storage systems generally consist of multiple nuclear fuel rod assemblies positioned in a fuel storage grid that is placed in a steel inner container and a concrete and steel outer container.

The hazards posed by spent fuel makes it difficult to transport. For this reason, government regulators require spent fuel to be shipped in containers or casks that shield and contain the radioactivity and dissipate the heat. In the U.S., spent fuel has typically been transported via truck or rail although other nations also use ships for spent fuel transport.

Spent fuel can be reprocessed to produce additional nuclear fuel. Even after commercial fuel is considered "spent," it still contains unused uranium along with other re-usable elements such as plutonium which is generated within the fuel while it is in the reactor and fission products. Current reprocessing technologies separate the spent fuel into three components: uranium, plutonium (or a plutonium-uranium mix), and waste, which contains fission products and transuranic elements that are produced within the fuel. The plutonium is mixed with uranium and fabricated into new fuel while the fission products and other waste elements are packaged into a new form for disposal.

Regardless of whether spent fuel is reprocessed or directly disposed of, every approach to the nuclear fuel cycle requires disposal of spent fuel that assures the very long-term isolation of radioactive wastes from the environment. Many nations, including those engaged in reprocessing, are working to develop disposal facilities for spent fuel and/or high level waste, but no such facility has yet been put into operation. Every nation that is developing disposal capacity plans to use a deep, mined geologic repository for this purpose.

The lack of operational disposal facilities makes storage that much more important. Storage in some form, for some period of time, is an inevitable part of the nuclear fuel cycle. In the early days of the nuclear energy industry it was assumed that storage times for spent fuel would be relatively short—on the order of several years to a decade or two at most—before spent fuel would be sent either for reprocessing or final disposal.

The current reality is much different. Storage is not only playing a more prominent and protracted role in the nuclear fuel cycle than once expected, it is the only element of the back end of the fuel cycle that is currently being deployed on an operational scale in the U.S. In fact, much larger quantities of spent fuel are being stored for much longer periods of time than policy-makers envisioned or utility companies planned for when most of the current fleet of reactors were built.

The dominant form of storage for spent fuel at operating reactor sites is wet storage in pools. In some countries, pools are even used at consolidated storage facilities that are distant from the reactor sites. Pools are the de facto storage solution because they are essential to operating a nuclear power plant given the need to cool newly discharged spent fuel close to the reactor core. Once spent fuel is in the pool, it is easy and inexpensive to leave it there for long periods of time.

Storing spent fuel in pools presents a number of problems. One problem is the limited capacity of the pools. Over the years, the pools fill up until there is no more additional capacity. The operator of the reactor must then transfer some of the spent fuel to dry storage, which is an expensive and difficult operation.

Another problem is that spent fuel stored in pools is susceptible to natural disasters such as earthquakes. The earthquake may cause the pool to lose water and the spent nuclear fuel to meltdown. The Fukushima disaster in Japan is an example of a cooling pool losing water causing the spent fuel to overheat and meltdown.

Another problem is that spent fuel can begin to lose its structural integrity when stored for long periods of time in a pool. Once this happens, the structural integrity of the spent fuel must be restored, a process that requires considerable time and resources.

After an initial period of cooling in wet storage (generally at least five years), dry storage (in casks or vaults) is the preferred option for extended periods of storage (i.e., multiple decades up to 100 years or possibly more). Unlike wet storage systems, dry systems are cooled by the natural circulation of air and are less vulnerable to system failures and natural disasters.

The most common type of dry storage system is shown in FIG. 1. The system includes a canister 12 that encloses multiple spent nuclear fuel rod assemblies 10. The canister 12 is positioned inside a concrete structure or cask 14. The canister 12 is formed of ½ inch to ⅝ inch thick stainless steel or concrete and serves as the primary boundary to confine radioactive material.

The canister 12 can be oriented vertically or horizontally inside the cask 14. The cask 14 is a reinforced concrete structure that provides shielding from radiation and protects the canister 12. The cask 14 can be positioned in a vault 16 for long term storage as shown in FIG. 2.

Casks can be designed and licensed as single-purpose casks (storage only), dual-purpose casks (storage and transport), and multi-purpose casks (storage, transport, and disposal). Typically, the more uses the casks are licensed for, the more they cost.

Conventional cask systems present a number of problems. One is that many nuclear power plants require expensive and time-consuming upgrades to make it possible to handle and maneuver the casks while loading them with spent nuclear fuel assemblies. For example, many of these plants have to retrofit the pool area with a larger overhead crane to handle the tremendous load of the casks. These improvements can cost tens of millions of dollars, which tends to deter plant operators from moving spent fuel from wet storage to dry storage.

Another problem with conventional cask systems is that unless the cask is a multi-purpose cask, there is a good chance that the bare fuel assemblies will need to be handled again in order to transport and/or eventually dispose of the spent fuel. Handling bare fuel greatly increases the difficulty and cost required to transport and/or dispose of the spent fuel.

The current management strategy for spent nuclear fuel relies on dry storage to provide adequate capacity to allow continued operation of commercial nuclear plants. Utilities meet their interim storage needs on an individual basis with large-capacity, dry storage casks that are focused on meeting existing storage and transportation requirements because disposal requirements are not available.

The problem with this is that disposal of the large canisters currently used by the commercial nuclear power industry represents many significant engineering and scientific challenges. Additionally, the expanded use of high-burnup (>45 GWd/MTU) fuel increases licensing uncertainty associated with transporting existing spent nuclear fuel.

The problem is exacerbated by the uncertainty surrounding the requirements for the geological disposal repository. For example, several repositories under consideration are formed of materials (i.e., clay/shale, salt, and crystalline rock) that require limited canister/cask sizes due to thermal or physical constraints. This combined with the above discussion indicates that the canister/casks that end up satisfying the as yet unknown disposal requirements will likely be significantly different than what is being used for dry storage today.

This difference means that the existing canisters/casks will likely need to be repackaged in canisters/casks that satisfy future transportation and disposal requirements. Repackaging the spent nuclear fuel for the purpose of transportation and/or disposal, particularly following an extended storage period, creates radiological, operational, and financial liabilities and uncertainties and should be avoided or minimized.

Given the current status, the most imminent service needed worldwide for spent fuel management is the supply of sufficient and prolonged storage capacity that solves one or more of the problems identified above for the future spent fuel inventory arising from both the continued operation of nuclear power plants and from the removal of fuel in preparation for plant decommissioning.

SUMMARY

A number of representative embodiments are provided to illustrate the various features, characteristics, and advantages of the disclosed subject matter. It should be understood, however, that other embodiments can be created by combining individual features and/or components of the explicitly disclosed embodiments. For example, the features, characteristics, advantages, etc., of one embodiment can be used alone or in various combinations and sub-combinations with one another to form other embodiments.

A system and method for managing spent nuclear fuel includes managing the spent fuel from the time it is discharged from the reactor to the time it is disposed of in a geological repository. The system and method is not limited to managing spent nuclear fuel that comes straight from the reactor. It can also accommodate spent nuclear fuel regardless of what stage it is at in the back end of the nuclear fuel cycle. For example, spent fuel stored in pools or in dry storage can be incorporated into the system.

The system includes a small capacity canister that encloses or encapsulates up to six spent nuclear fuel rod assemblies. In the preferred embodiment, the canister is sized and configured to enclose a single spent nuclear fuel rod assembly. Individually enclosing the spent nuclear fuel rod assemblies maximizes the advantages of the system. It should be appreciated, however, that canisters that enclose more than one spent nuclear fuel rod assemblies can still realize many of the benefits of the system.

The canister is engineered to satisfy safety related criteria while minimizing reliance on other systems and components that are difficult to monitor or examine such as the cladding integrity of the fuel rods. The canister is also engineered to be versatile. It can be used in connection with multiple disposal paths. The canister also provides flexibility for meeting existing and future licensing objectives and requirements.

The canister is configured to receive and enclose a spent nuclear fuel rod assembly in an air tight fashion. In effect, the spent nuclear fuel rod assembly is sealed inside the canister. Multiple canisters are loaded into a cask for interim storage and/or transport. The canister can eventually be disposed of in the geological repository.

A method for enclosing a spent nuclear fuel rod assembly in the canister includes positioning a single spent nuclear fuel rod assembly in the canister and closing or sealing the canister to make it air tight. Alternatively, two to six spent nuclear fuel rod assemblies can be sealed in a single canister.

In one embodiment, the canister is lowered over a spent nuclear fuel rod assembly positioned in a staging rack in a pool such as the spent nuclear fuel pool (cooling pool) that is part of a commercial nuclear power station. In other embodiments, the spent nuclear fuel rod assembly may be lowered into the top of a stationary canister. Loading the canister preferably takes place in a pool, but can also take place outside of a pool, such as, for example, at an interim dry storage location.

The staging rack can include multiple holding areas each of which is configured to receive and support a spent nuclear fuel rod assembly. A retaining member is positioned at the bottom of each holding area underneath the spent nuclear fuel rod assembly. The canister moves over the spent nuclear fuel rod assembly until it reaches the bottom and engages the retaining member. The retaining member is coupled to the bottom of the canister in such a way that the spent nuclear fuel rod assembly is held in the can as the canister is lifted out of the pool.

The canister is lifted out of the pool and water is allowed to drain out the bottom through openings in and around the retaining member. The interior of the canister is actively or passively dried and a cover is secured to the bottom of the canister to make it air tight. The canister is filled with an inert gas up to a pressure of about 1 psi to 3 psi.

The canister includes a coupler or fitting through which the inert gas can pass into the interior of the canister. Once the coupler is no longer needed, a cap is sealed over it to make the top of the canister air tight. With the cap in place, there is no way for gas to escape from the canister.

In one embodiment, the cap, bottom cover and other components of the canister are welded together. The welds are inspected radiographically to make sure that it is completely sealed and meets all applicable standards. The use of radiographic testing is advantageous because it can eliminate the need to provide double containment such as, for example, a secondary enclosure. Alternatively, the canister can be enclosed in a second canister that is slightly larger to provide double containment.

The sealed canister is put back in the staging rack in the pool. The canister can remain in the pool indefinitely or can be transferred to a cask for dry storage. Alternatively, the canister can be transferred directly to a cask without being put back in the pool.

It should be noted that storing sealed canisters in the pool is preferable to storing bare spent nuclear fuel rod assemblies. For example, if the water level unexpectedly drops, the spent nuclear fuel is much less likely to produce a radioactive event because it is enclosed in the canister. The Fukushima disaster in 2011 is a good example. If the spent nuclear fuel rod assemblies had been enclosed in canisters, then they would have been much less likely to have released harmful radiation to the environment.

It may be desirable to periodically transfer groups of canisters from the pool to storage casks. In one embodiment, a transfer platform is placed on the staging rack directly above a group of canisters. A cask is positioned above the transfer platform and the group of canisters are lifted into the cask. The canisters are maintained in a fixed, spaced apart relationship to each other in the cask to facilitate criticality safety.

The cask can be stored in a vault at the interim storage area at the reactor site or in a vault at a consolidated storage area that is not part of the reactor site. In one embodiment, the cask is configured to be put directly in the vault without removing the canisters from the cask. In another embodiment, the cask is a transfer cask and the canisters are transferred from the transfer cask to a storage cask, which can be placed in the vault.

The vault can have a modular construction so that the capacity of the vault can be expanded on an as-needed basis instead of as a large, one-time capital expenditure. The vault can include a plurality of panels, preferably made of concrete and/or steel, that can be coupled together to form one or more chambers each of which is configured to receive and hold a cask.

The system includes the following main components: a staging rack, a canister, a canning module, a transfer rack, a cask, and a vault. The canister includes an elongated tubular member having a top and a bottom, a first end cover coupled to the top of the tubular member and a second end cover coupled to the bottom of the tubular member. The staging rack and the transfer rack are positioned in the pool and used to facilitate enclosing the spent nuclear fuel rod assemblies in the canister and moving them out of the pool.

The canning module is positioned out of and adjacent to the pool and is used to enclose or seal the canister with the spent nuclear fuel rod assembly inside. The cask can be used to transport and/or store multiple canisters on-site or off-site (e.g., an intermediate waste transfer station). It should be appreciated that one cask can be used to remove the canisters from the pool and another cask can be used to store the spent nuclear fuel rod assemblies in a vault. The vault holds the casks and provides shielding and passive cooling.

The casks can be licensed for on-site and/or off-site usage. For example, one cask can be designed and licensed for on-site transport and/or storage. Another cask can be designed and licensed for off-site transport and/or storage (dual-use cask). Yet another cask can be designed and licensed for off-site transport and/or storage as well as final disposal (multi-purpose cask).

The Summary is provided to introduce a selection of concepts in a simplified form that are further described below in the Detailed Description. The Summary and the Background are not intended to identify key concepts or essential aspects of the disclosed subject matter, nor should they be used to constrict or limit the scope of the claims. For example, the scope of the claims should not be limited based on whether the recited subject matter includes any or all aspects noted in the Summary and/or addresses any of the issues noted in the Background.

DRAWINGS

The preferred and other embodiments are disclosed in association with the accompanying drawings in which.

DETAILED DESCRIPTION

Figure 1:
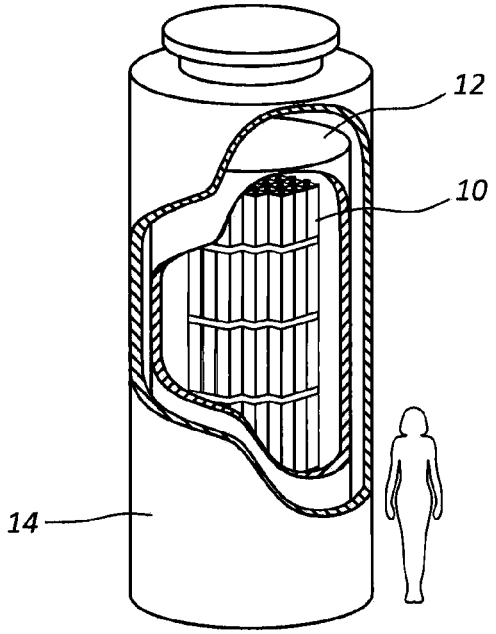
FIG. 1 Prior Art
FIG. 1 shows a conventional dry storage container and cask.
Figure 2:
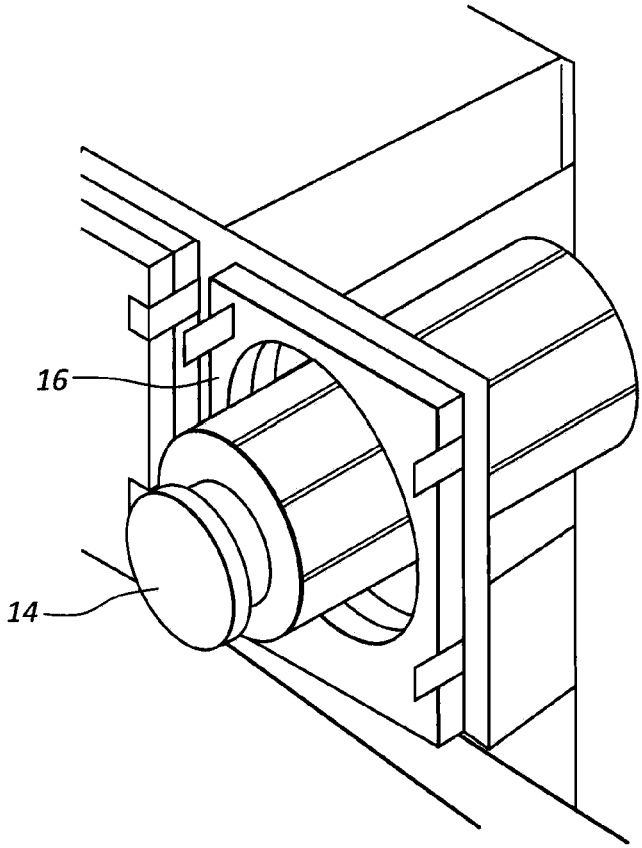
FIG. 2 Prior Art
FIG. 2 shows a conventional vault for the cask shown in FIG. 1.

A system is disclosed for flexibly and safely managing the entire back end of the nuclear fuel cycle. The spent nuclear fuel is managed from the time it is discharged from the reactor to the time it is disposed of in a geological repository. The system is also capable of managing legacy spent nuclear fuel that is stored in dry storage.

The system includes a small capacity canister 20 that is preferably configured to enclose or encapsulate up to six spent nuclear fuel rod assemblies 22. Preferably, the canister 20 is sized and configured to enclose a single spent nuclear fuel rod assembly 22. However, in other embodiments, the canister 20 is sized to enclose two, three, four, five, or six spent nuclear fuel rod assemblies 22.

The canister 20 is engineered to satisfy various safety related criteria associated with storing and transporting spent nuclear fuel. The canister 20 is configured to provide a sealed containment enclosure for the nuclear fuel rod assembly 22. If the cladding on the spent fuel rods deteriorates, it will still be contained inside the canister 20.

The canister 20 is also versatile. For example, the canister 20 can be used in connection with multiple storage and disposal paths. The canister 20 can be loaded with a spent fuel assembly 22 and then stored in a pool or in a dry storage vault. Once the disposal criteria has been established, the canister 20 can be transferred to an appropriate disposal cask or directly disposed without the need to handle and expose bare fuel, especially bare fuel that has been in storage for decades.

Conventional systems enclose large numbers of spent fuel assemblies 22 in large canisters and casks. Enclosing individual or small groups of the spent fuel assemblies 22 in a single canister 20 provides a number of advantages over conventional systems.

One advantage is that expensive upgrades to the reactor site are not required. Conventional canisters and casks are so large that most reactor sites must be retrofitted with expensive upgrades just to lift and move the canisters and casks. The canister 20 and associated components are small enough that they can be handled using the existing reactor site infrastructure. For example, the overhead crane present at most spent fuel pools can be used to handle the canister 20 and associated components although it is too small to handle the enormous size of conventional canisters and casks.

The use of the canister 20 provides the ability to enclose the spent fuel assemblies 22 immediately or shortly after exiting the reactor core, which significantly increases the safety of the system. If the pool loses water like it did in Fukushima Japan, the spent fuel assemblies 22 will still be contained in the canisters 20. This will prevent a large scale release of radioactive particles into the environment.

Individually enclosing the spent fuel assemblies 22 in the canisters 20 makes them much easier to handle and transport, both now and in the future, because they are always contained. Once the fuel assemblies 22 are sealed in the canisters 20, there is no need to handle bare spent fuel again. If the canisters 20 need to be transferred to a different cask or system for interim storage of final disposal, then they can without exposing the bare fuel.

One of the reasons the Yucca Mountain disposal site is so complex and expensive is because it is designed to handle bare fuel assemblies 22. If this was no longer required, then it would significantly reduce the complexity and cost of the geologic disposal site regardless whether it is at Yucca Mountain or somewhere else. The same considerations apply to regional interim storage sites.

The canister 20 provides structural support and integrity to the spent fuel assemblies 22. One of the problems with storing spent fuel assemblies for long periods of time is that they lose their structural integrity, e.g., the cladding on the spent fuel rods can crack or break. Once this happens, it becomes much more difficult and expensive to handle the spent fuel assemblies 22. Enclosing the spent fuel assemblies 22 in the canister 20 prevents this from happening Enclosing the spent fuel assemblies 22 in the canisters 20 allows for passive cooling of the spent fuel assemblies 22 during dry storage. Air can enter the bottom of the vault or cask, travel upward past the canisters 20, and exit through openings in the top.

Turning to the Figs., they show the canister 20 sized and configured to enclose a single spent fuel assembly 22. It should be appreciated, however, that the canister 20 can be designed to hold up to six spent fuel assemblies 22 as mentioned above. The canister 20 can include a framework that holds the spent fuel assemblies 22 in a fixed, spaced apart relationship to each other.

The framework can be configured to hold the spent fuel assemblies 22 in the most compact way possible. For example, if the canister includes four spent fuel assemblies 22, then they may be arranged in a 2×2 matrix. Also, if the canister includes six spent fuel assemblies 22, then they can be arranged in a 2×3 matrix. Numerous other configurations are possible.

Figure 3:
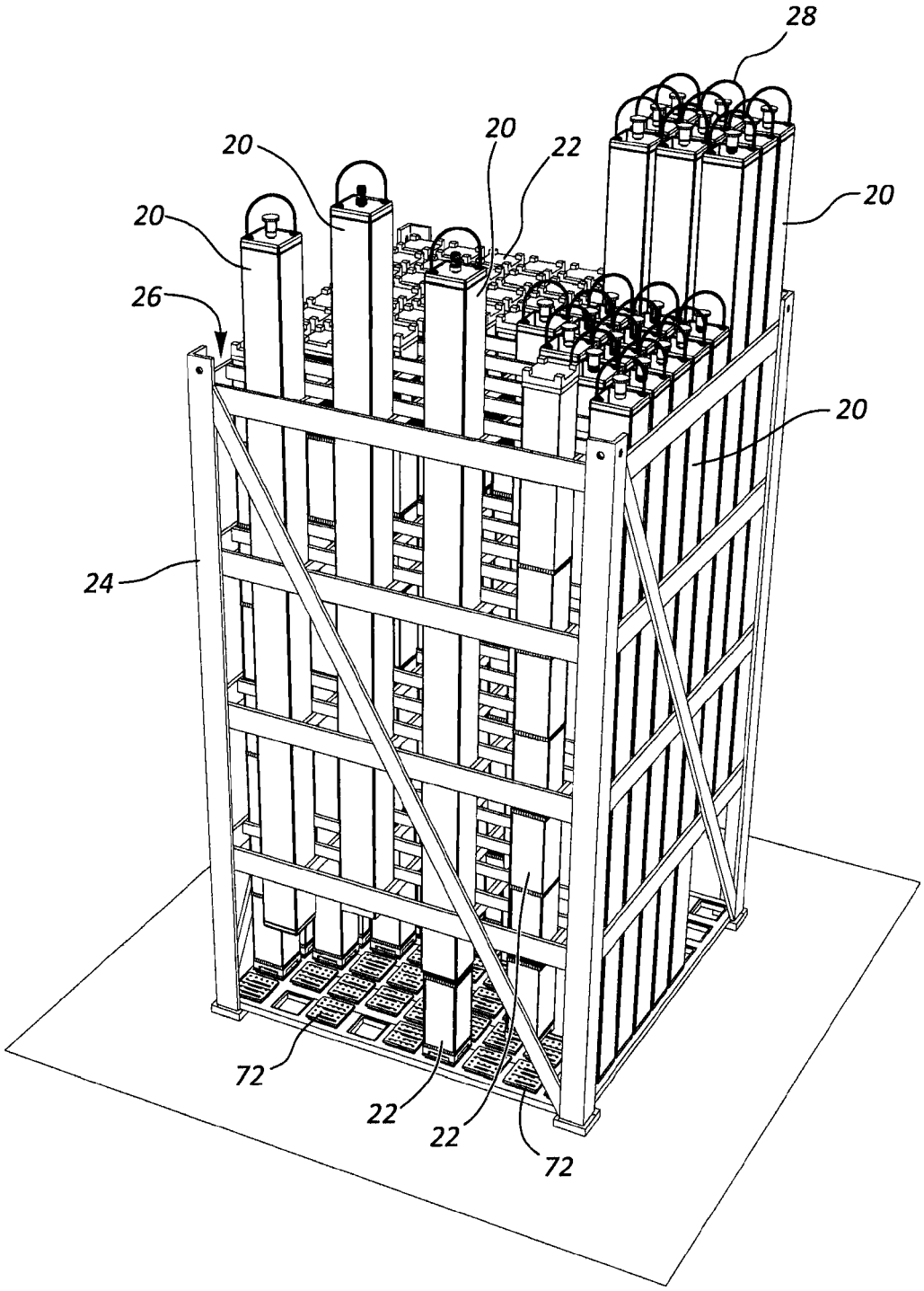
FIG. 3 shows one embodiment of a staging rack positioned in a pool where the staging rack includes bare spent nuclear fuel assemblies and canisters loaded with spent nuclear fuel assemblies.

Turning to FIG. 3, a staging rack 24 is shown positioned at the bottom of a spent nuclear fuel pool (also referred to as a cooling pool). The staging rack 24 includes a plurality of holding areas 26 (also referred to as holding bays) each of which is sized to receive and securely hold the canisters 20 and the spent fuel assemblies 22 in an upright position.

The staging rack 24 includes the bare spent fuel assemblies 22 in the left rear area and the loaded canisters 20 in the right rear area. The canisters 20 have lifting members 28 (also referred to as handles) on the top and the bare spent fuel assemblies 22 do not. The canisters 20 and bare spent fuel assemblies 22 positioned along the front of the staging rack 24 illustrate the process of enclosing the spent fuel assemblies 22, which is discussed in greater detail later.

The term "spent nuclear fuel rod assembly" and corresponding terms such as spent fuel assembly" shall mean the bundle or cluster of nuclear fuel rods held together in a fixed relationship to each other by a framework. This is a discrete assembly of nuclear fuel rods that is positioned inside a nuclear reactor.

The spent fuel assembly 22 can have a variety of sizes and configurations. For example, the spent fuel assembly 22 can have any suitable length and cross-sectional shape. The spent fuel assembly 22 can be 1 m to 15 m long and have a rectangular, circular, hexagonal, or other cross-sectional shape.

The configuration of the spent fuel assembly 22 largely depends on the type of reactor and characteristics of the fuel rods. The preponderant fuel type currently used for the majority of commercial nuclear power today is that required for the LWR. However, there are other fuel types in commercial use such those used in HWR reactors, GCR reactors, RBMK reactors, etc. Table 1 below shows some of the main characteristics of these fuel types and their respective associated fuel cycle post-operation disposition.

TABLE 1

Fuel types in commercial use in the world

| Reactor Type | Design | Physical Specs. | Notes |
|---|---|---|---|
| LWR | PWR | Square/hexagonal cross-section | Usually stored intact |
| | BWR | 4 m to 5 m long | Fuel rods are consolidated in fuel assemblies |
| | WWER | 200 kg to 500 kg per assembly | |
| PHWR | CANDU | Ø 10 cm × 50 cm 20 kg per bundle | Handled in tray/basket |
| GCR | Magox | Ø 3 cm × 1.1 m long slug; | Usually reprocessed |
| | AGR | 24 cm diameter, 1 m long assembly | Dry storage possible |
| Others | RBMK | Ø 8 cm × 10 m long assembly (2 sections) | Sized to half length for storage |
| | PBMR | Ø 6 cm spherical fuel element | Canned for storage |

The nuclear fuel rods in the spent fuel assemblies 22 can have any suitable configuration. In one embodiment, the nuclear fuel rods include a plurality of nuclear fuel pellets clad in a sleeve or rod of zirconium oxide. The pellets are stacked up, enclosed, and sealed in a zirconium alloy tube to form a single nuclear fuel rod.

Figure 4:
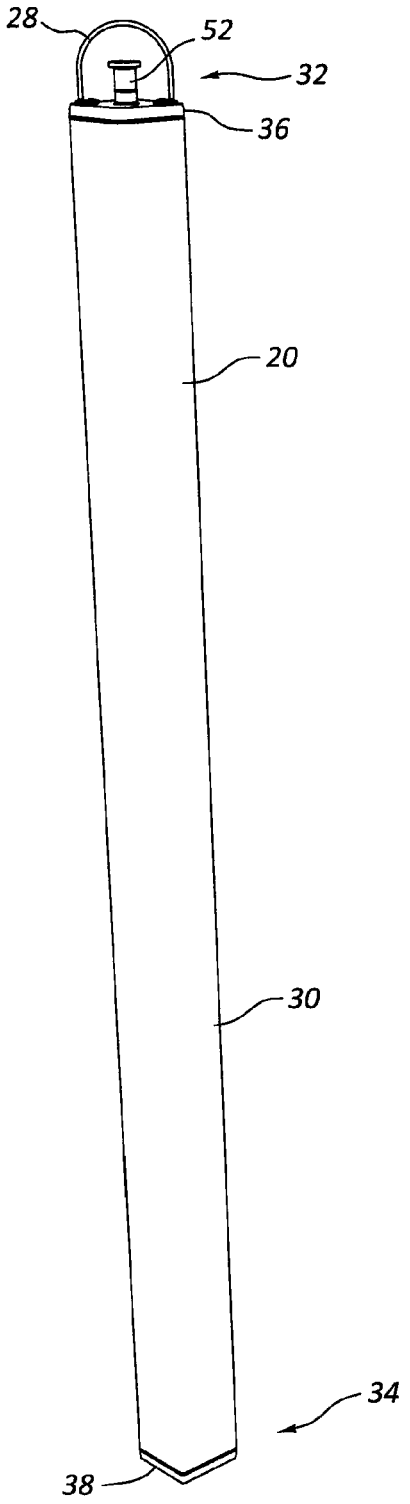
FIG. 4 shows a perspective view of one embodiment of a canister that is configured to enclose a spent nuclear fuel assembly.
Figure 5:
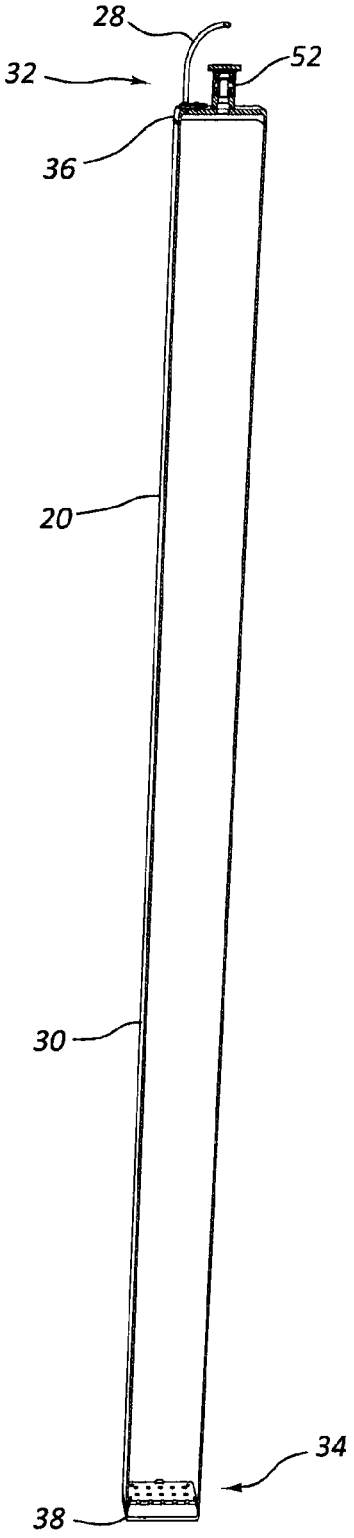
FIG. 5 shows a cross-sectional perspective view of the canister in FIG. 4.

Before describing the process of loading the canisters 20 with the spent fuel assemblies 22, the construction of the canisters 20 is described with reference to FIGS. 4-14. FIG. 4 shows a perspective view of the canister 20. FIG. 5 shows a cross-sectional perspective view along a cross-sectional plane that extends longitudinally the length of the canister 20.

The canister 20 includes an elongated tubular member 30 (also referred to as a tubular body or main body), a first end cover 36 coupled to the top end 32 (also referred to as a first end) of the tubular member 30 and a second end cover 38 coupled to the bottom end 34 (also referred to as a second end) of the tubular member 30. The covers 36, 38 close the ends 32, 34 of the tubular member 30. The second end cover 38 seals the bottom end 34 of the tubular member 30 so that it is air tight—i.e., so that gases cannot enter or escape.

It should be noted that for purposes of this disclosure, the term "coupled" means the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate member being attached to one another. Such joining may be permanent in nature or alternatively may be removable or releasable in nature.

The covers 36, 38 can be coupled to the tubular member 30 in any way so long as it produces an air tight seal. In one embodiment, the covers 36, 38 are welded to the tubular member 30. The welds can be inspected using radiographic testing to ensure that there are no flaws that could allow gas to escape through the welds. Radiographic testing can be used to ensure compliance with ASME standards so that it is not necessary to use a double containment system, e.g., two canisters 20 enclosing a single spent fuel assembly 22.

It should be appreciated that the above techniques can be used to couple together any of the components described in this document. Other fasteners and fastening techniques can also be used depending on the situation. For example, bolts, screws, adhesives, and the so forth, can be used to couple the various components together.

Figure 6:
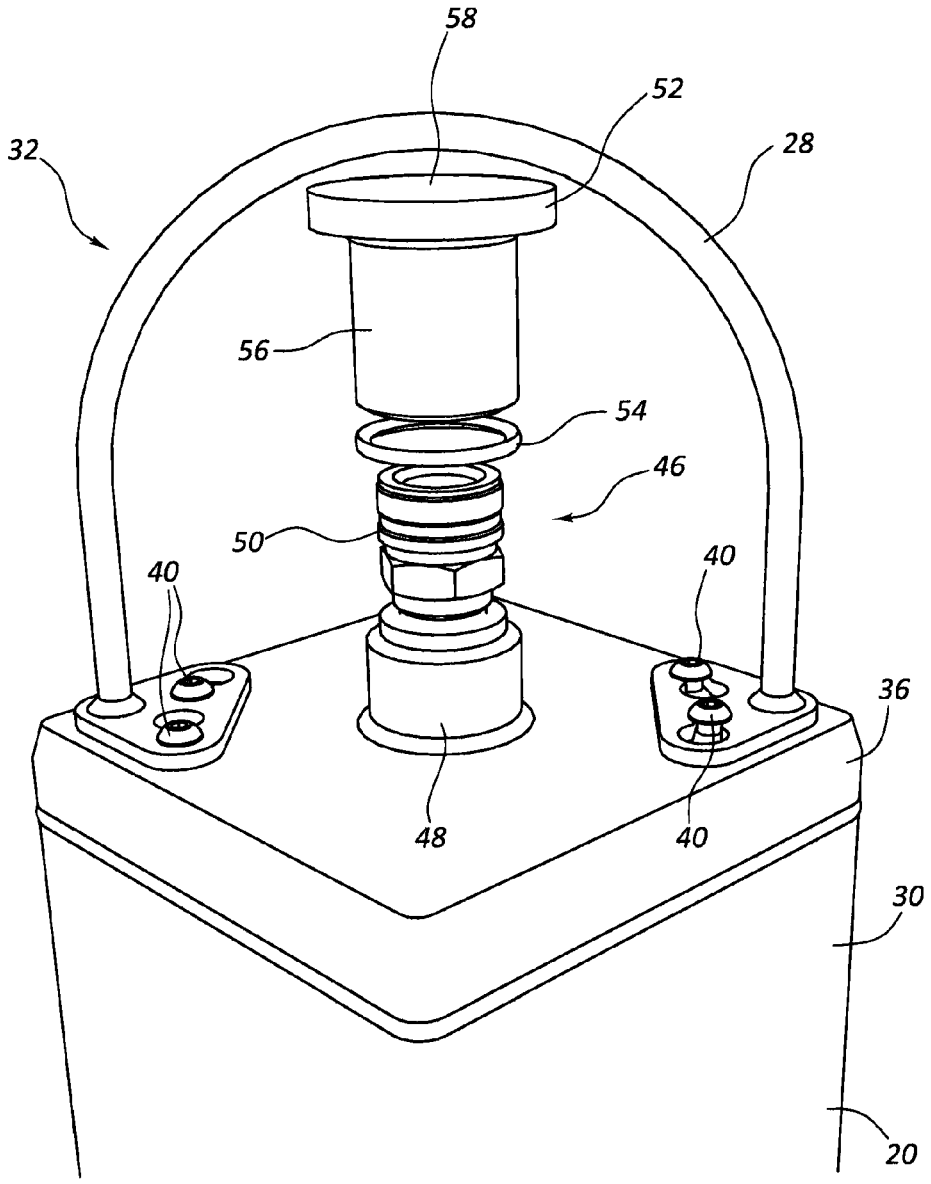
FIG. 6 shows a perspective view of the top of the canister.
Figure 7:
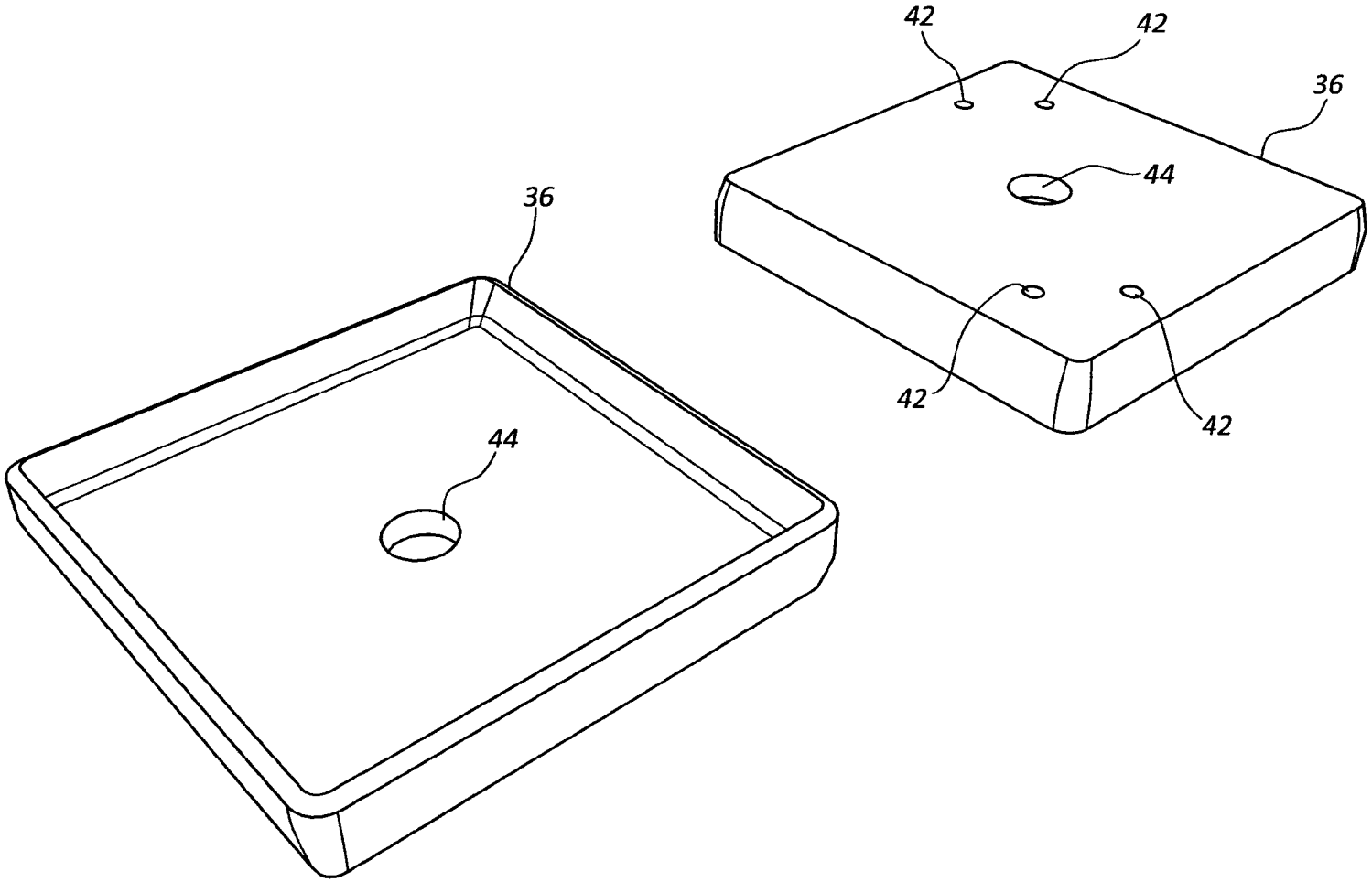
FIG. 7 shows perspective views of a first end cover that is used to seal the top end of the canister.

The top end 32 of the canister 20 is shown in greater detail in FIG. 6. The first end cover 36 is welded to the tubular member 30 as explained above. The lifting member 28 is coupled to the top of the first end cover 36 using fasteners 40 that engage corresponding holes 42 in the first end cover 36. FIG. 7 shows that the holes 42 do not extend all the way through the first end cover 36.

The lifting member 28 provides a convenient way for a crane or other lifting device to engage and lift the canister 20. The lifting member 28 in FIG. 6 is a removable bail that includes a loop that extends from one corner of the first end cover 36 upward and then back down to the opposite corner of the first end cover 36. It should be appreciated that the lifting member 28 can have any suitable configuration so long as it is capable of being used to lift the canister 20. The lifting member 28 can also be coupled to other components of the canister 20 such as the tubular member 30.

In an alternative embodiment, a threaded lifting member is provided to enable lifting with a suitable remotely operated lifting device. An example of a threaded lifting member and corresponding remotely operated lifting device is a Zip Lift available from FastTorq, New Caney, Tex.

Figure 8:
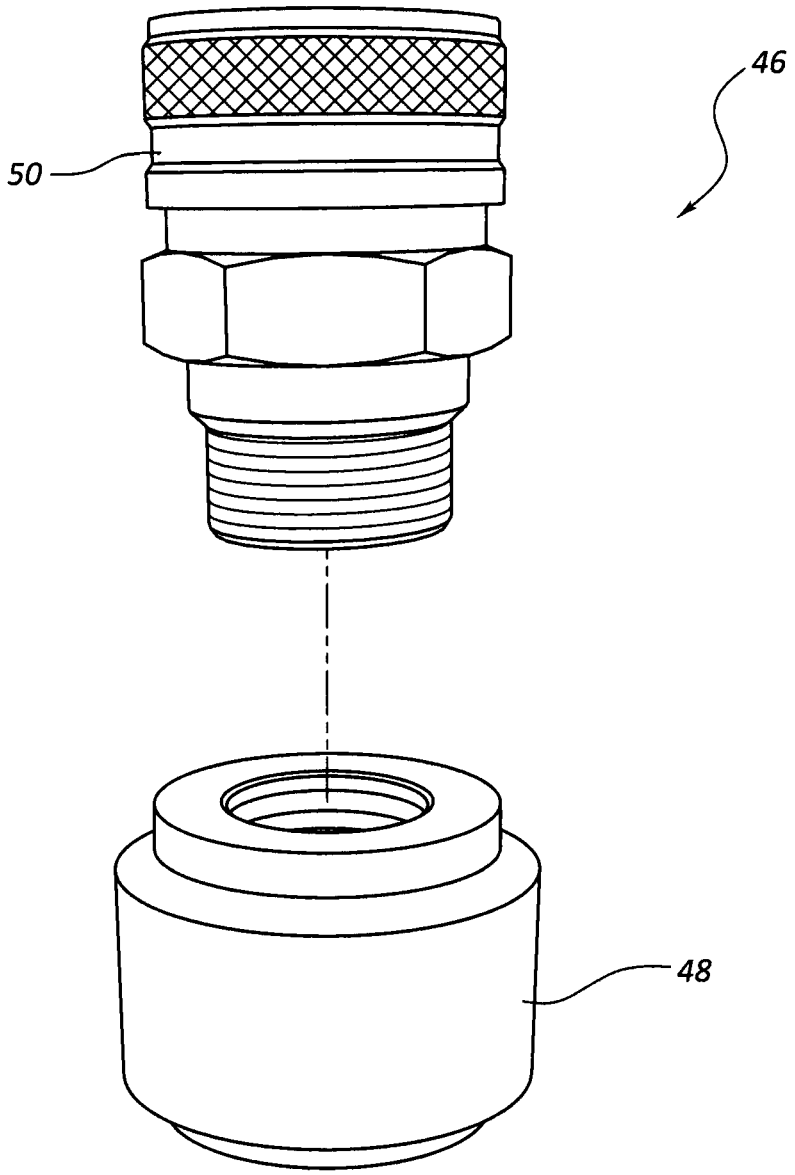
FIG. 8 shows a perspective view of a coupler or fitting positioned at the top of the canister and configured to provide a valved passageway into the interior of the canister.

Referring to FIG. 7, the first end cover 36 includes a hole 44 through which fluids can pass into the interior of the canister 20. A coupler 46 is coupled to the first end cover 36 over the hole 44. The coupler 46 is shown in FIG. 8. The coupler 46 defines a passageway through the front end cover 36 and into the interior of the canister 20.

The coupler 46 includes a sleeve 48 and a quick release fitting 50. The sleeve 48 is coupled to the top of the first end cover 36. In the embodiment shown in FIG. 6, the sleeve 48 is welded to the first end cover 36. The sleeve 48 provides a secure base to which the quick release fitting 50 can be coupled.

Returning to FIG. 8, the quick release fitting 50 is coupled to the sleeve 48 using a threaded engagement. The quick release fitting 50 is a female type fitting and is configured to receive a corresponding male quick release fitting 50. The quick release fitting 50 includes a valve assembly that is closed when the corresponding male quick release fitting 50 is not present and is open when it is present and securely coupled to the quick release fitting 50.

The coupler 46 can be attached to a vacuum pump to remove residual moisture from the canister 20. The coupler 46 can also be used to supply gases such as air, inert gases (noble gases), heated gases, and so forth to the interior of the canister 20. For example, the coupler 46 can be used to supply heated air to dry the interior of the canister 20 including the spent fuel assembly 22. The coupler 46 can also be used to charge the loaded canister 20 with inert gases for long term storage and/or disposal of the spent fuel assembly 22.

It should be appreciated that the configuration of the coupler 46 shown in the Figs. is but one example of numerous other configurations it can have. For example, the coupler 46 can be positioned at other locations on the canister 20 such as the tubular member 30 or the second end cover 38. Also, the coupler 46 can be provided with or without a valve that closes the passageway into the canister 20.

Referring to FIG. 6, the canister 20 includes a cap member 52 positioned over the coupler 46 and coupled to the first end cover 36. The cap member 52 encloses the coupler 46 and seals the passageway so that it is air tight. The cap member 52 is welded to the top of the first end cover 36 in the embodiment shown in FIG. 6. The weld 54 is shown separately to depict that it can be a v-groove fillet type weld.

The cap member 52 includes a tubular body 56 capped with a circular end plate 58. The tubular body 56 is sized to fit over the coupler 46. The circular end plate 58 is welded to the tubular body 56 to seal the two components together in an air tight manner.

Figure 9:
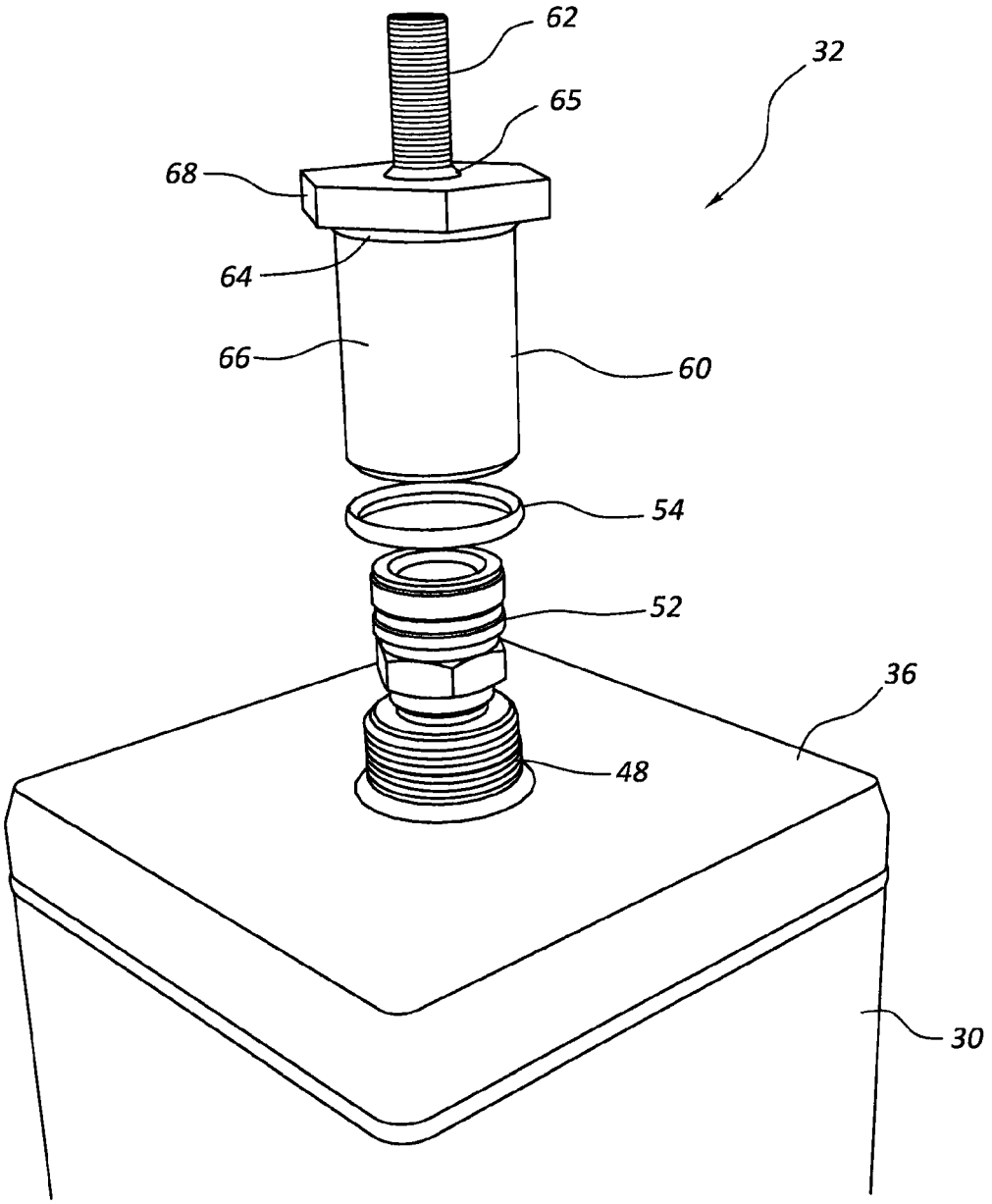
FIG. 9 shows a perspective view of a cap member that fits over and seals the coupler in FIG. 8.
Figure 10:
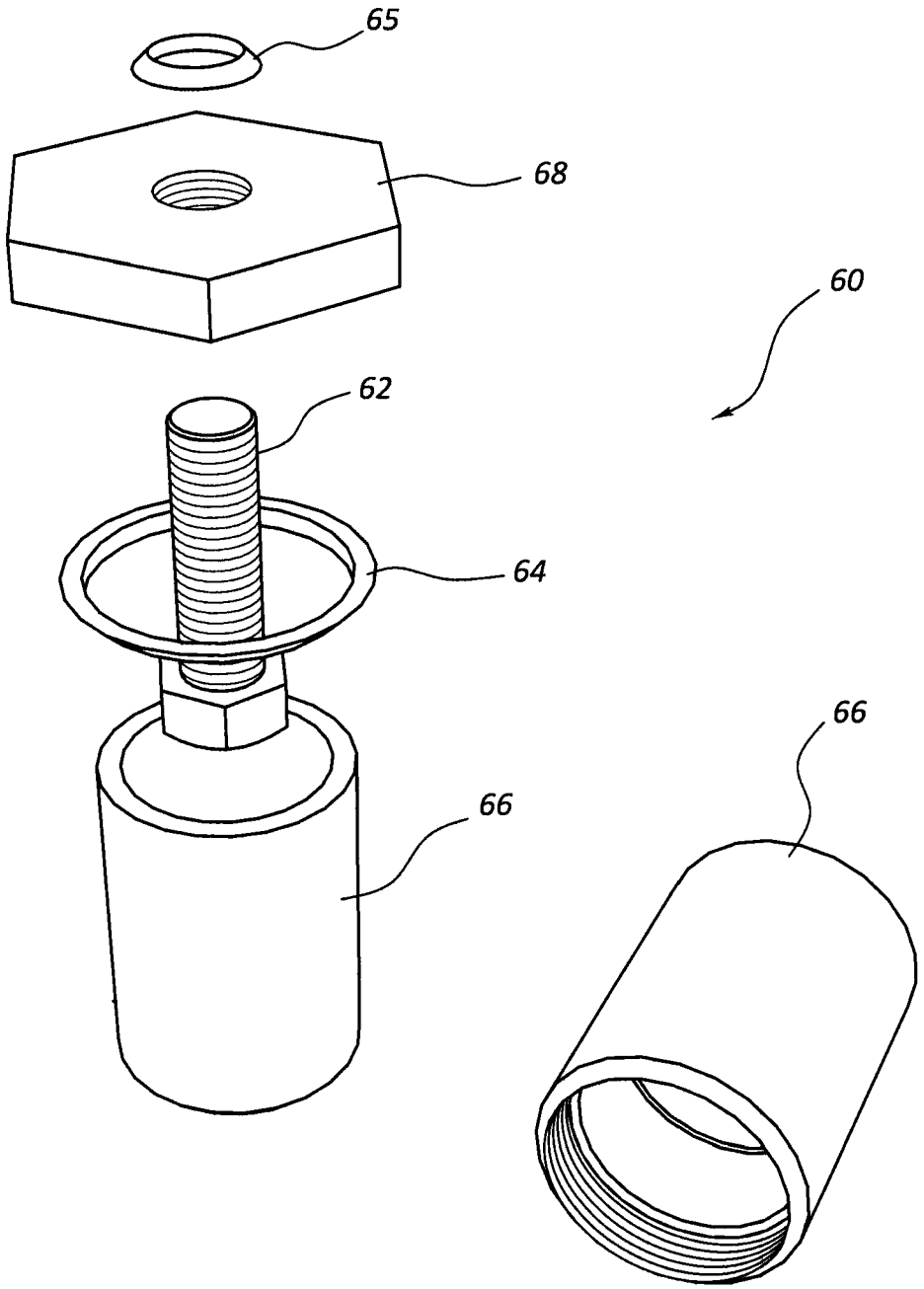
FIG. 10 shows an exploded perspective view of the cap member in FIG. 9.

FIGS. 9-10 show another configuration for the top end 32 of the canister 20. In this embodiment, the cap member 60 includes the lifting member 62. The cap member 60 includes a tubular body 66 and circular end plate 68 welded to the top of the tubular body 66 with weld 64. The lifting member 62 is a threaded rod that is coupled to and extends upward from the circular end plate 58. In this embodiment, the lifting member 62 is both welded (weld 65) and threaded to the circular end plate 58 but it should be appreciated that these components could be coupled together in other ways.

The cap member 60 includes threads that engage corresponding threads on the sleeve 48 of the coupler 46. This allows the cap member 60 to be screwed on to the coupler 46 and then welded in place for a strong and secure connection.

In another embodiment, the cap member 56 can be used to lift the canister 20 without a separate lifting member. For example, the circular end plate 58 forms a lip that could be engaged by lifting equipment such as cranes. In this situation, the cap member 56 doubles as a lifting pintle.

Figure 11:
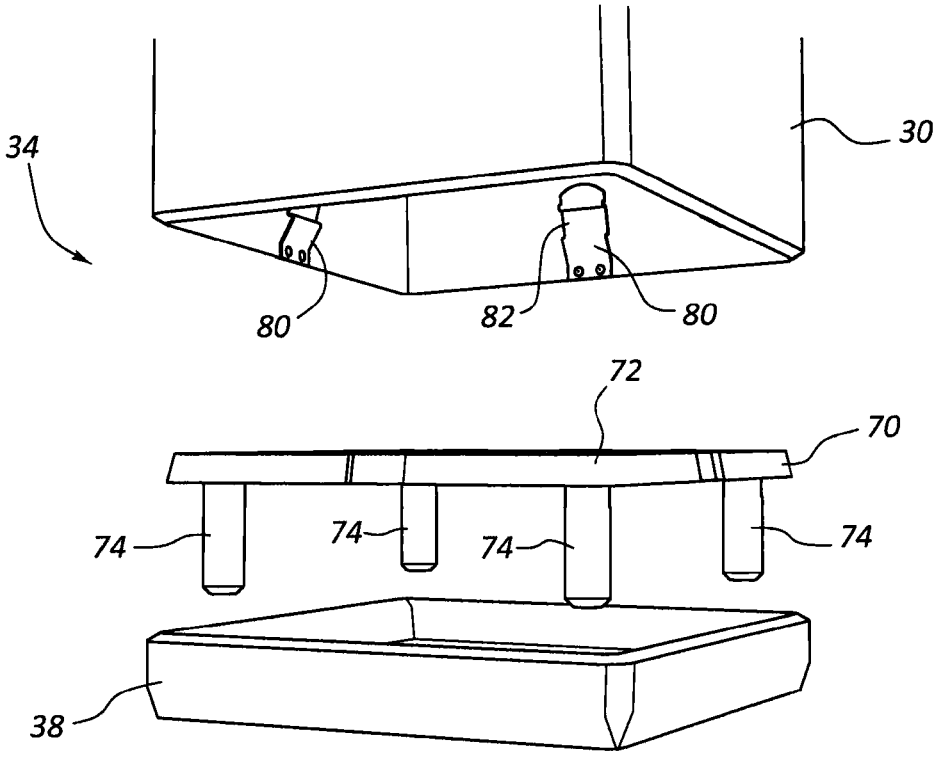
FIG. 11 shows an exploded perspective view of the bottom of the canister.
Figure 12:
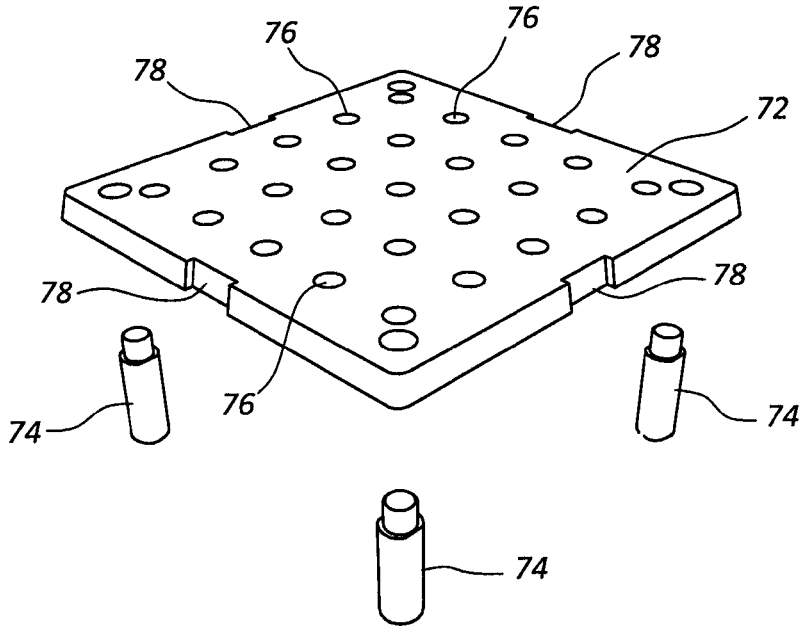
FIG. 12 shows an exploded perspective view of a retaining member positioned at the bottom of the canister.
Figure 13:
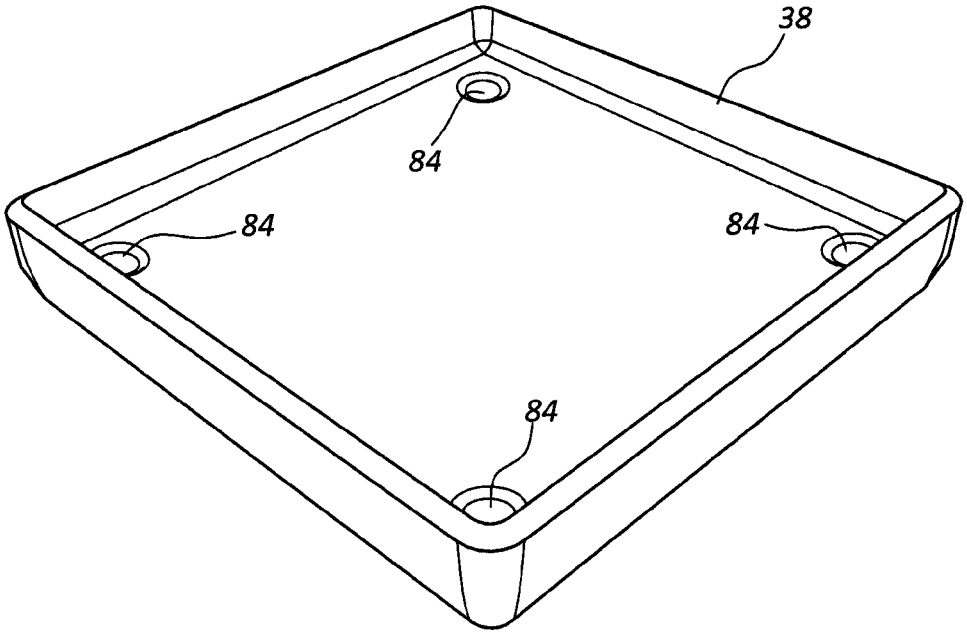
FIG. 13 shows a perspective view of a second end cover that is used to seal the bottom end of the canister.
Figure 14:
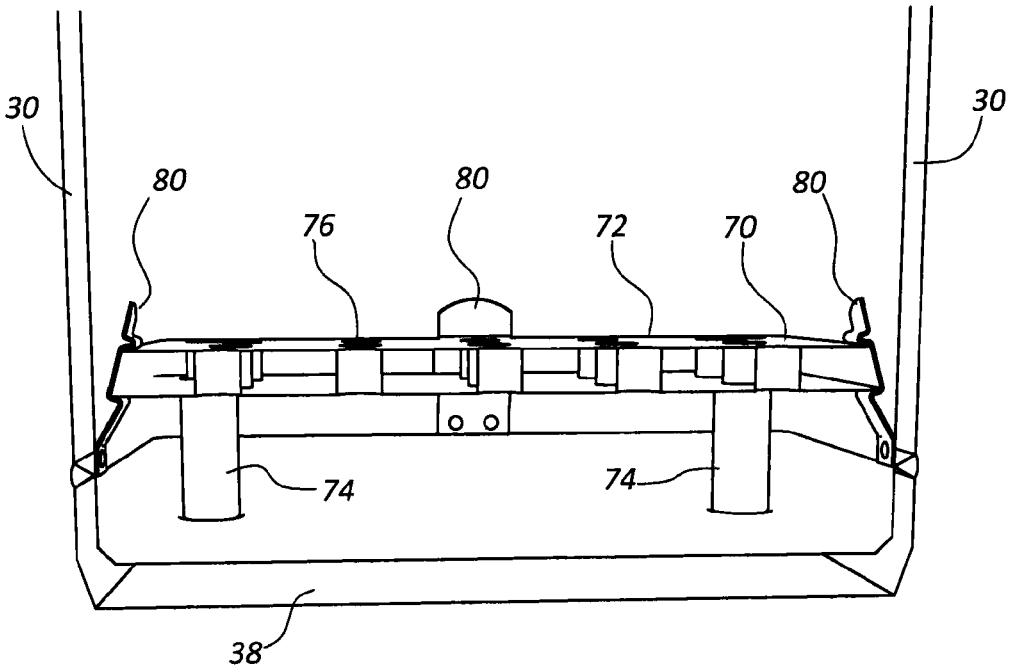
FIG. 14 shows a cross-sectional view of the fully assembled and sealed bottom end of the canister.
Figure 15:
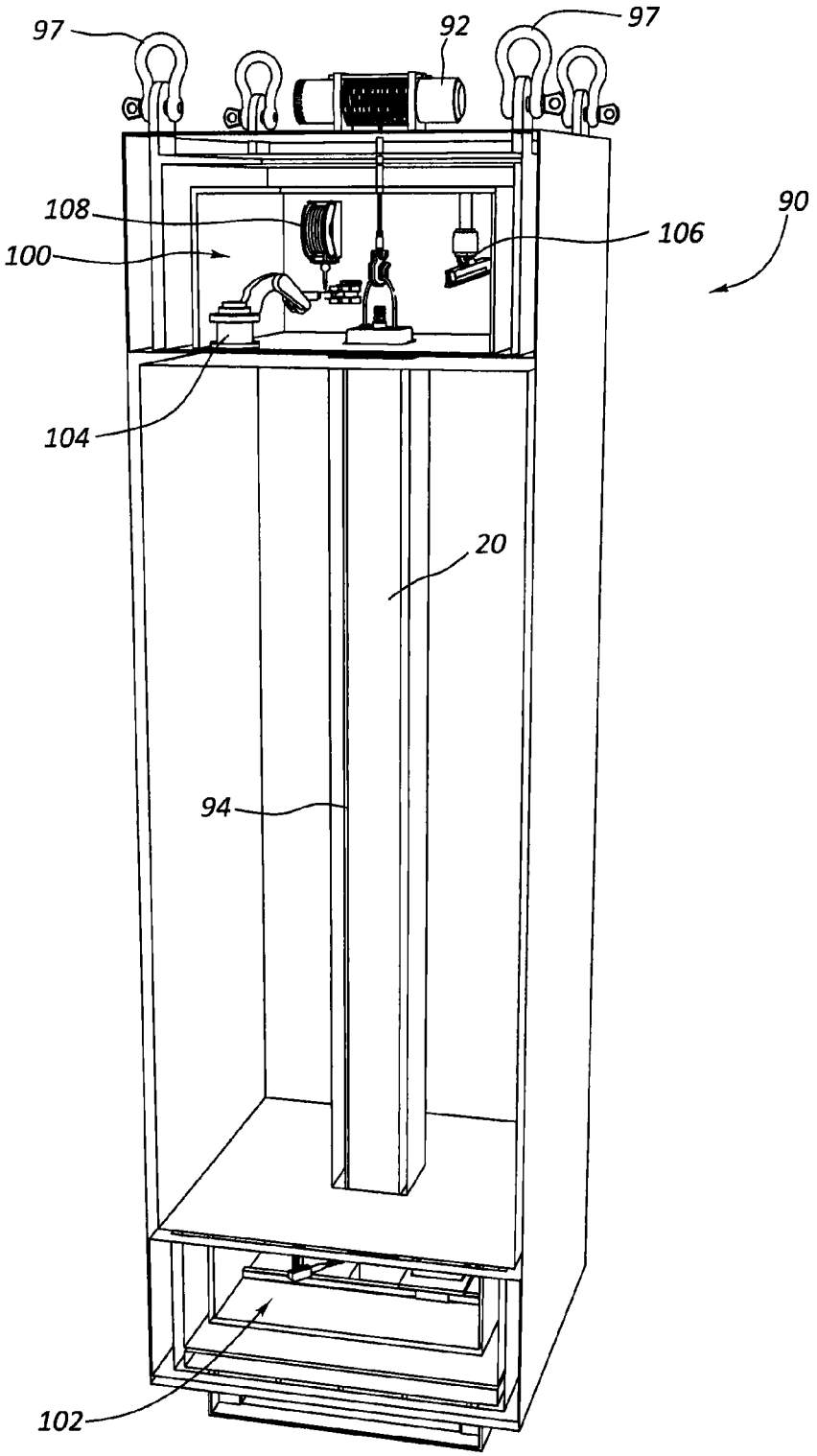
FIG. 15 shows a cross-section perspective view of a canning module that is used to seal the canisters to make them air tight.

The construction of the bottom end 34 of the canister 20 is shown in FIGS. 11-14. FIG. 11 shows an exploded view of the bottom end 34 that includes the bottom end of the tubular member 30, a retaining member 70, and the second end cover 38. The retaining member 70 fits inside the tubular member 30 and the second end cover 38 is coupled to the bottom end of the tubular member 30 to seal the bottom end 34 of the canister 20 closed.

The second end cover 38 is coupled to the tubular member 30 in any suitable manner. In one embodiment, the second end cover 38 is welded to the tubular member 30 in a similar manner as the first end cover 36. It should be appreciated, however, that any of the other fastening techniques described in this document could be used as well.

The retaining member 70 includes a support plate 72 (also referred to as a support member) and support posts 74 positioned underneath the support plate 72. The support plate 72 includes a plurality of holes 76 that extend through the support plate 72 and are arranged in a regular pattern. The holes 76 are provided to allow water to drain out the bottom of the canister 20 through the retaining member 70.

It should be appreciated that the configuration of the retaining member 70 shown in the Figs. is but one example of a suitable configuration. The retaining member 70 can have a variety of additional configurations. For example, the retaining member 70 can be configured to allow water through gaps between the edges of the support plate 72 and the walls of the tubular member 30 instead of or in addition to the holes 76. Also, the support plate 72 can have a concave or convex shape instead of a flat plate shape. Numerous other configurations are possible.

The support plate 72 includes recesses 78 that are configured to engage retaining latches 80 (also referred to as tabs) coupled to the interior walls of the tubular member 30. The retaining latches 80 are biased outward from the interior walls of the tubular member 30. As the support plate 72 enters the bottom of the tubular member 30, the recesses 78 contact the latches 80 and bias them toward the interior walls of the tubular member 30 until the recesses 78 reach a corresponding recess 82 in the latches 80. At this point, the latches 80 bias outward from the interior walls of the tubular member 30 and the recesses 78, 82 engaged each other holding the retaining member 70 in place.

This arrangement allows the tubular member 30 to be coupled to the retaining member 70 by lowering the tubular member 30 on to the retaining member 70. As the tubular member 30 is lowered, the latches 80 contact the support plate 72 and hold the retaining member 70 in the position shown in FIG. 14.

The retaining member 70 is configured to support the weight of the spent fuel assembly 22. Before the second end cover 38 is put in place, the weight is supported entirely by the latches 80. Once the second end cover 38 is put in place, the support posts 74 rest on the inside surface of the second end cover 38 and transfer the weight load from the support plate 72 to the second end cover 38. The second end cover 38 includes recesses 84 that correspond to the support posts 74 to keep the support posts 74 in an upright position over the long term and through numerous moves.

The canister 20 and any of its components can be made of any suitable material. In one embodiment, the canister 20, including the tubular member 30 and the covers 36, 38 are made of stainless steel that is at least 3 mm thick (e.g., 3 mm to 7 mm). It should be appreciated that other materials can be used as well such as composites, carbon steel, various alloys, and the like. The exterior of the canister 20 can have a smooth finish (e.g., 2B finish for stainless steel) to facilitate decontamination.

Criticality control can be provided using a variety of different techniques. In one embodiment, the canister 20 does not include a borated neutron absorber. Criticality control is provided by soluble boron credit, geometric spacing and moderator exclusion. In another embodiment, the canister 20 includes a borated neutron absorber surrounds the spent fuel assembly 22.

The canister 20 can also be any suitable size. In one embodiment, the canister 20 is sized to at least roughly correspond to the size of an individual spent fuel assembly 22. For example, if the spent fuel assembly 22 is square like those in the Figs., then the canister 20 is square and slightly larger to enable it to receive the spent fuel assembly 22. If the spent fuel assembly 22 is hexagonal, then the canister 20 would also be hexagonal and so forth.

In one embodiment, the canister 20 has cross-sectional dimensions of approximately 24 cm×24 cm. The canister 20 can be any suitable height such as 1 m to 35 m, 2 m to 30 m, and so forth.

Referring back to FIG. 3, one embodiment of a process for loading the canisters 20 with spent fuel assemblies 22 is shown. The process is represented by the canisters 20/spent fuel assemblies 22 shown in the first row of the staging rack 24. The process proceeds from right to left.

The first step in the process is to position a retaining member 72 at the bottom of each holding area 26. A bare spent fuel assembly 22 is positioned in the holding area 26 on top of the retaining member 72 as shown by the bare spent fuel assembly 22 positioned on the right side of the front row of the staging rack 24. The spent fuel assembly 22 is shown as it is being lowered down on to the retaining member 72.

The canister 20 is then lowered over the spent fuel assembly 22 as depicted in the middle right position of the front row of the staging rack 24. The canister 20 has been lowered most of the way down but has not yet reached the retaining member 72. Note that the coupler 46 on the canister 20 has not been enclosed by the cap member 56.

The canister 20 is lowered until it reaches and is coupled to the retaining member 72 in the manner described above. The retaining member 72 is coupled to the bottom end 34 of the canister 20 and is configured to support the weight of the spent fuel assembly 22. The canister 20 is lifted out of the pool and water drains out the bottom end 34 through the holes 76 in the retaining member 72. The canister 20 being lifted out of the pool is depicted in the middle left position of the front row of the staging rack 24.

While out of the pool, the interior of the canister 20 is dried, charged with an inert gas, and then the canister 20 is sealed air tight. The details of this process are described in greater detail as follows. The second end cover 38 and the cap member 52 are coupled to the canister 20 to seal it closed and make it air tight.

The canister 20 is returned to the staging rack 24 in the pool as shown by the left position of the front row of the staging rack 24. Alternatively, the canister 20 could be placed directly in a transfer cask or storage cask for dry storage instead of being returned to the pool. It should be noted that the canister 20 on the far left includes both the second end cover 38 and the cap member 52.

FIGS. 15-18 show one embodiment of a process for sealing the canister 20 using a canning module 90 that is positioned out of the pool. The process of sealing the canister 20 is designed to be controlled remotely so that personnel are not exposed to harmful radiation (e.g., ionizing particle and electromagnetic radiation). For example, the process can be controlled in a control room 86 such as that shown in FIG. 18.

Figure 16:
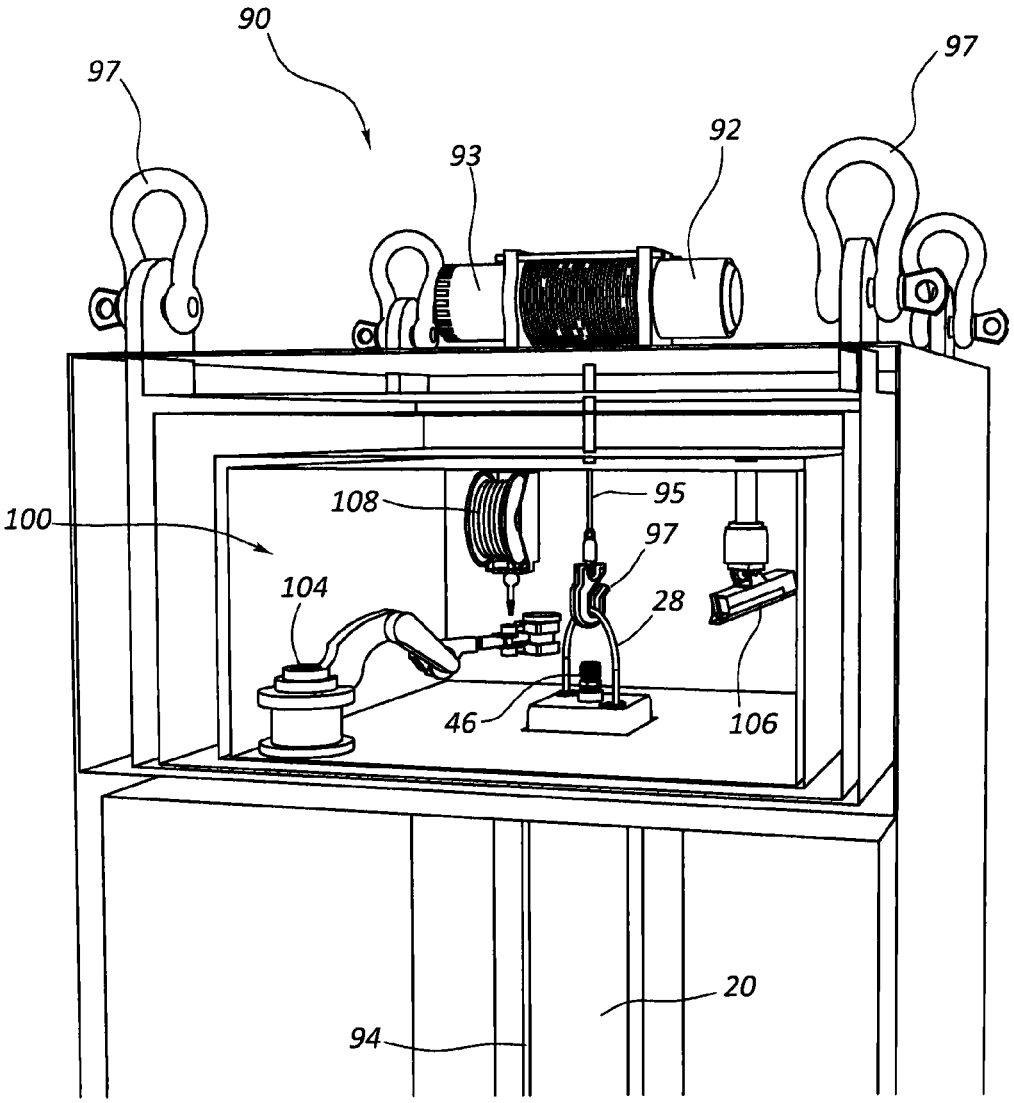
FIG. 16 shows a perspective view of the top chamber of the canning module.
Figure 17:
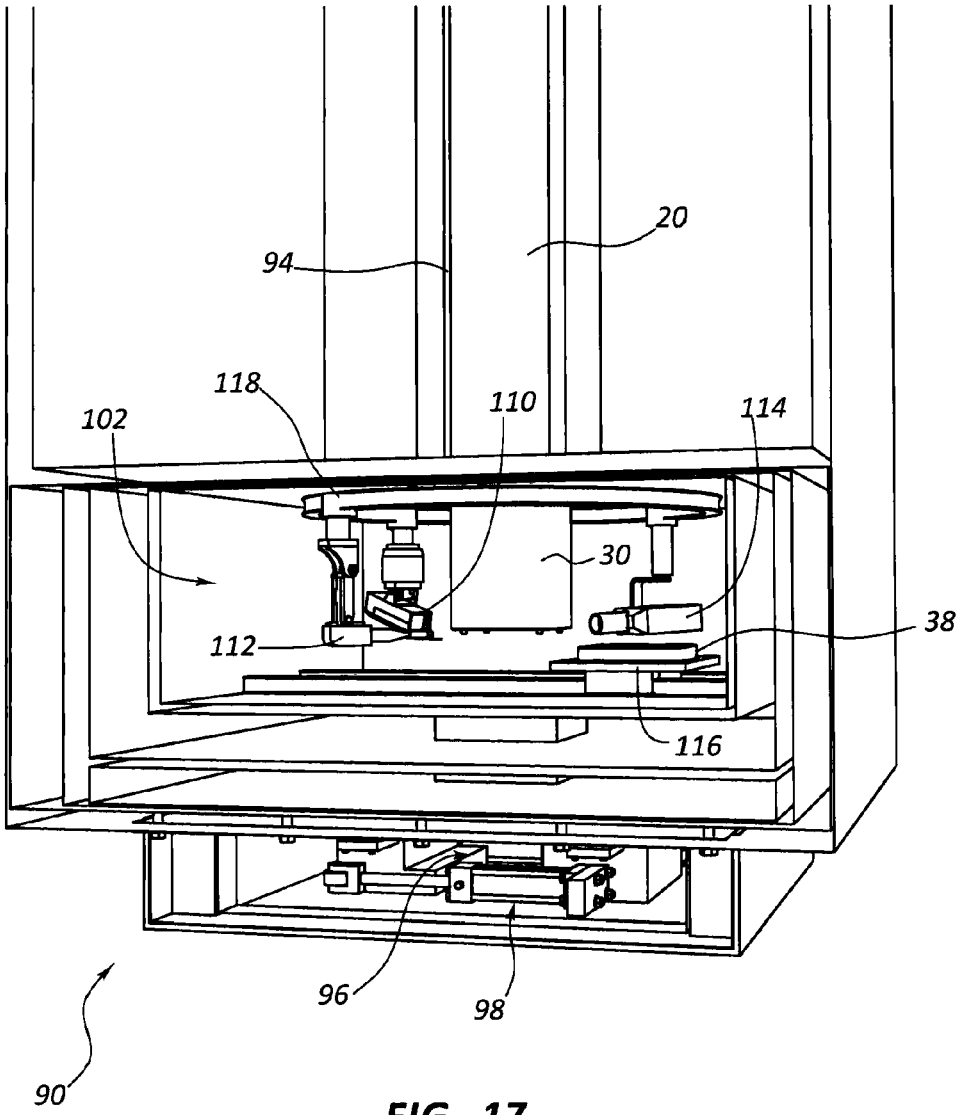
FIG. 17 shows a perspective view of the bottom chamber of the canning module.
Figure 18:
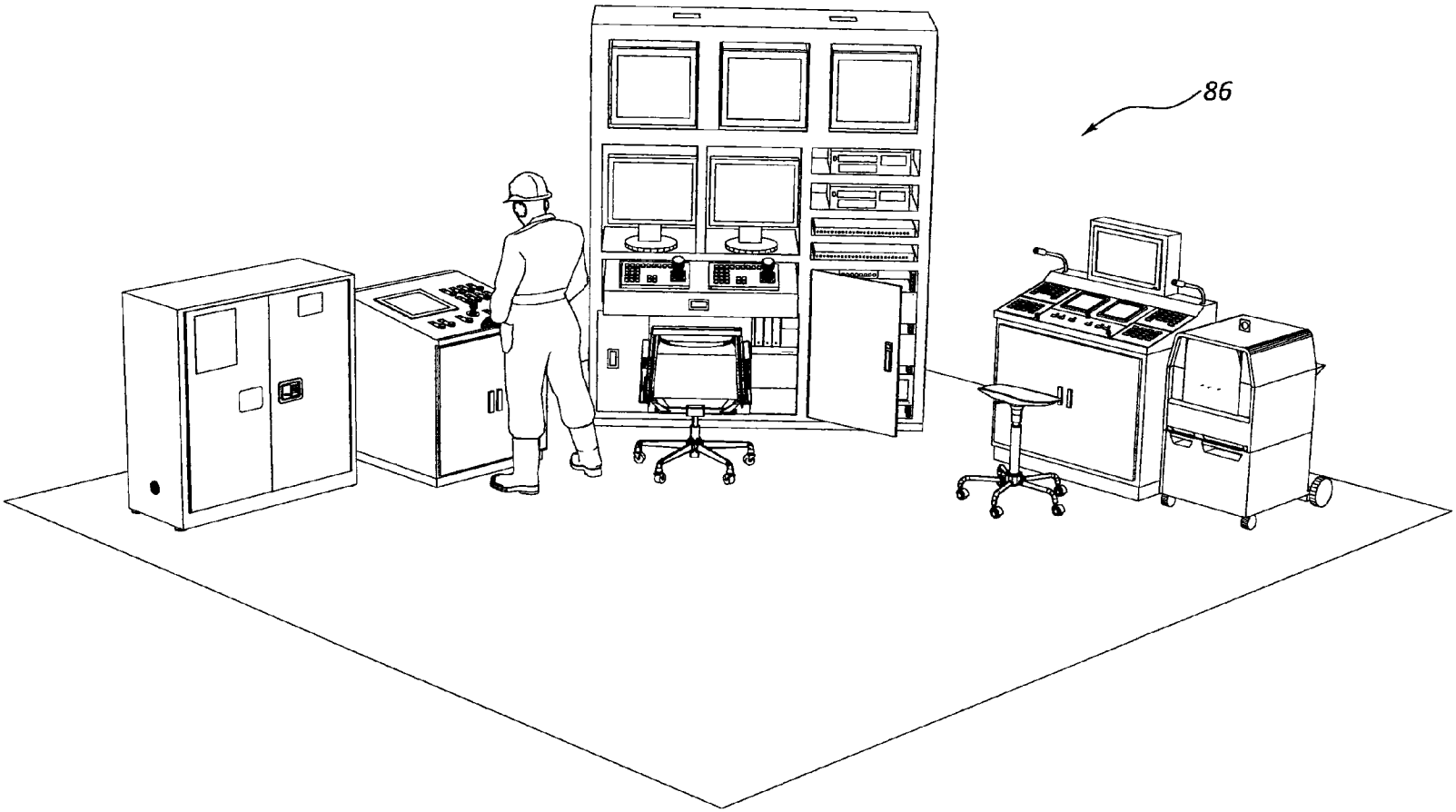
FIG. 18 shows a perspective view of a control room that is used to remotely control the canning module in FIG. 15.

The canning module 90 includes a lifting mechanism 92 that lifts the canister 20 out of the pool. In the embodiment shown in FIG. 15, the lifting mechanism 92 includes a winch 93, cable 95, and a hook 97 on the end of the cable 95 (FIG. 16). The hook 97 engages the lifting member 28 at the top of the canister 20. It should be appreciated that the lifting mechanism 92 can include any suitable mechanism in any configuration as long as it is capable of lifting the canister 20 into the canning module 90.

The canning module 90 includes lifting members 97 on the top that are configured to be coupled to a lifting mechanism such as a crane. The lifting members 97 allow the canning module 90 to be suspended above the pool while loading and unloading the canisters 20.

The canning module 90 includes an elongated, shielded chamber 94 that is sized to receive the canister 20. The canister 20 is lifted into the chamber 94 through an access door 96 at the bottom of the canning module 90. The chamber 94 is open at the top and the bottom to allow remote operations to be performed on the canister 20 such as drying the interior and sealing it air tight.

The top and bottom of the chamber 94 are referred to as top chamber 100 and bottom chamber 102 even though they are part of chamber 94. Alternatively, the chambers 100, 102 can be separate from the elongated chamber 94.

The canning module 90 includes multiple layers of shielding to protect against harmful radiation. The shielding can be provided by a variety of materials such as layers of concrete, lead, and so forth. The shielding is provided to prevent or reduce exposure to harmful electromagnetic radiation.

The access door 96 on the bottom of the canning module 90 can be closed by a door mechanism 98 (FIG. 17) to prevent exposure to harmful particle radiation. The door mechanism 98 includes one or more electric, hydraulic, or pneumatic actuators that close the access door 96 by, for example, sliding it closed.

The top chamber 100 includes components that allow the interior of the canister 20 to be remotely dried and facilitate putting the cap member 52 in place. For example, the top chamber 100 includes a robotic arm 104, video camera 106, and drying and inerting apparatus 108. The video camera 106 can be used to remotely monitor the process from the control panel 86.

The canister 20 undergoes the following operations in the canning module 90. The interior of the canister 20 is dried using the apparatus 108. In one embodiment, the apparatus 108 is configured to vacuum dry the interior of the canister 20. In another embodiment, the apparatus 108 is configured to blow air through the canister 20 to dry it. It should be appreciated that the interior of the canister 20 can be dried before or after the second end cover 38 is attached.

The drying and inerting apparatus 108 is configured to engage the coupler 46 on the top of the canister 20. The robotic arm 104 can be used to engage and/or disengage the apparatus 108 and the coupler 46.

Once the interior of the canister 20 is dry, it is charged with an inert gas. In one embodiment, the inert gas is a noble gas such as helium. The inert atmosphere prevents the spent fuel assembly 22 from oxidizing and/or otherwise decomposing during long periods of storage and/or after disposal. Alternatively, the interior of the canister 20 can be placed under a vacuum. It should be appreciated that the second end cover 38 should be put in place before the canister 20 is charged with inert gas.

The apparatus 108 can have any of a variety of configurations. In one embodiment, the apparatus 108 is replaced by two separate apparatuses. One apparatus is configured to dry the canister 20 and the other apparatus is configured to charge it with an inert gas. The disadvantage of this configuration is that it can require connecting and disconnecting the apparatuses from the coupler 46 multiple times.

Once the canister 20 is charged with inert gas, the cap member 52 is positioned over the coupler 46 and coupled to the canister 20 in the manner described above. A robotic welder can be used to weld the cap member 52 to the canister 20. In one embodiment, the robotic welder is mounted on a turntable to allow it to rotate all the way around the cap member 52. In another embodiment, the robotic arm 104 includes the robotic welder.

The bottom chamber 102 includes components used to couple the second end cover 38 to the tubular member 30. For example, the bottom chamber 102 can include a video camera 110, robotic welder 112, and a radiographic testing device 114. The video camera 112 can be used to remotely monitor the process from the control room 86.

The second end cover 38 is positioned on a staging platform 116 that can move vertically and horizontally. Once the canister 20 is in position, the staging platform 116 moves horizontally underneath the bottom end 34 of the canister 20. The staging platform then moves vertically until the second end cover 38 is positioned adjacent to or in contact with the bottom of the tubular member 30. The second end cover 38 is now in position to be welded to the tubular member 30.

The robotic welder 112 welds the second end cover 38 to the tubular member 30. In one embodiment, the robotic welder 112 is coupled to a turntable 118 that rotates around the exterior of the canister 20. The video camera 110 and the radiographic testing device 114 can also be coupled to the turntable 118. This allows a full 360 degree view of the welding operation.

The radiographic testing device 114 is used to inspect the welds to ensure that they meet applicable standards and do not contain any defects. If the welds are defective, then the robotic welder can be used to weld the area again and fix the defects.

It should be appreciated that the canister 20 can be sealed shut using any of a number of other methods and devices. For example, the process can be modified to seal the canister 20 in the pool while still drying and charging it with inert gas (e.g., an air lock can be used to remove the water from the canister 20). Numerous other modifications are also possible.

Figure 19:
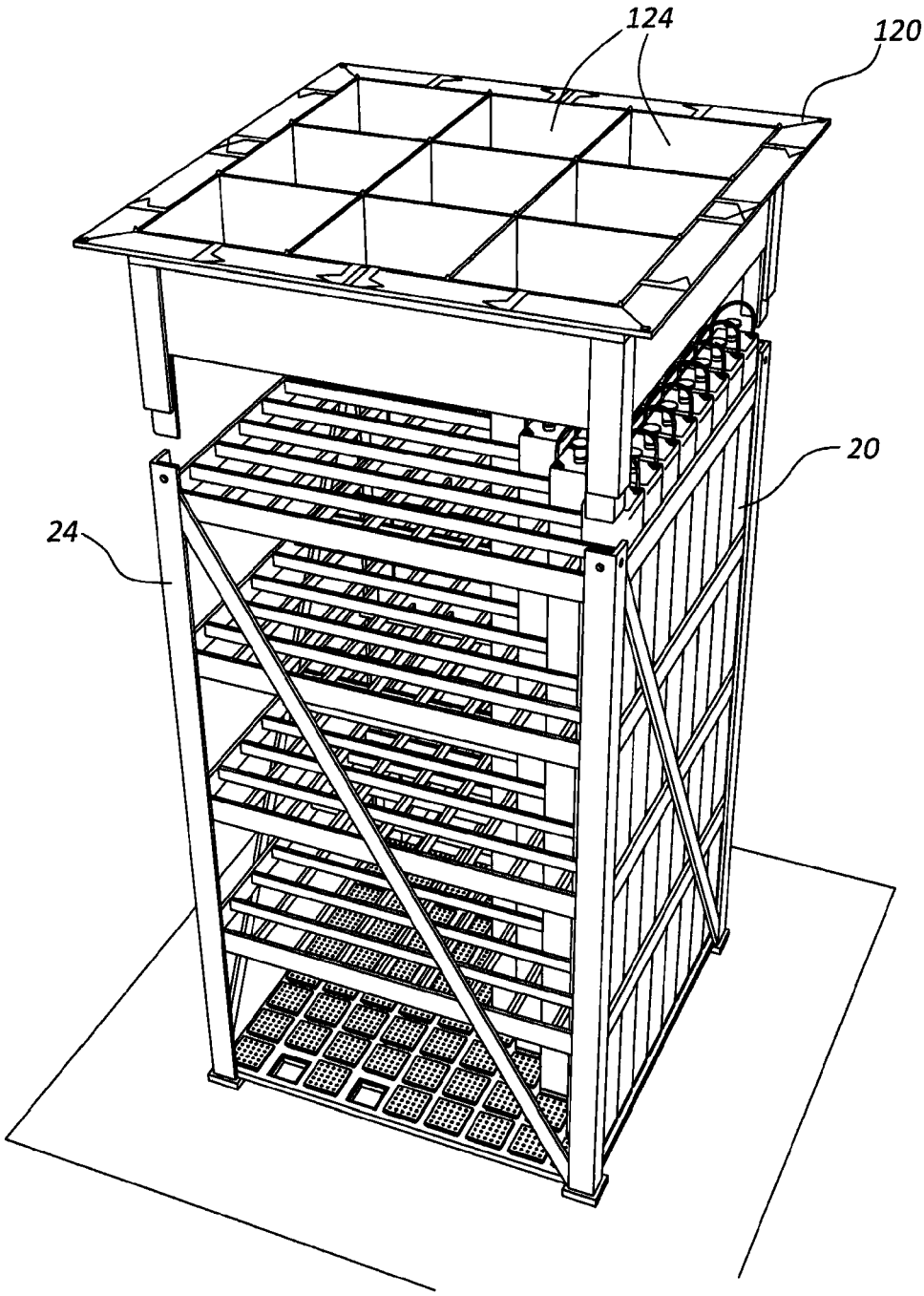
FIG. 19 shows a perspective view of a transfer platform positioned just above the staging rack in FIG. 3.
Figure 20:
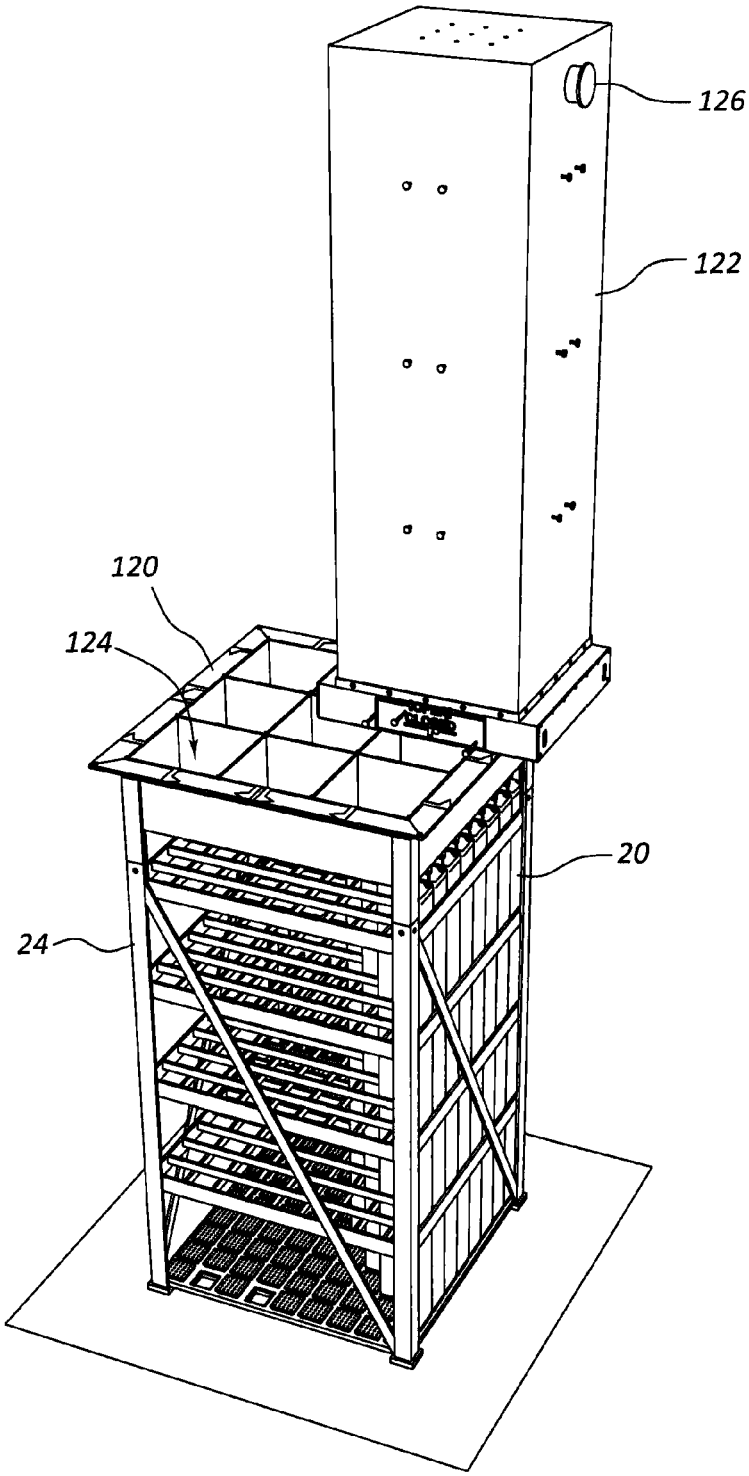
FIG. 20 shows a perspective view of the transfer platform in FIG. 19 coupled to the top of the staging rack with a transfer cask positioned on the transfer platform.
Figure 21:
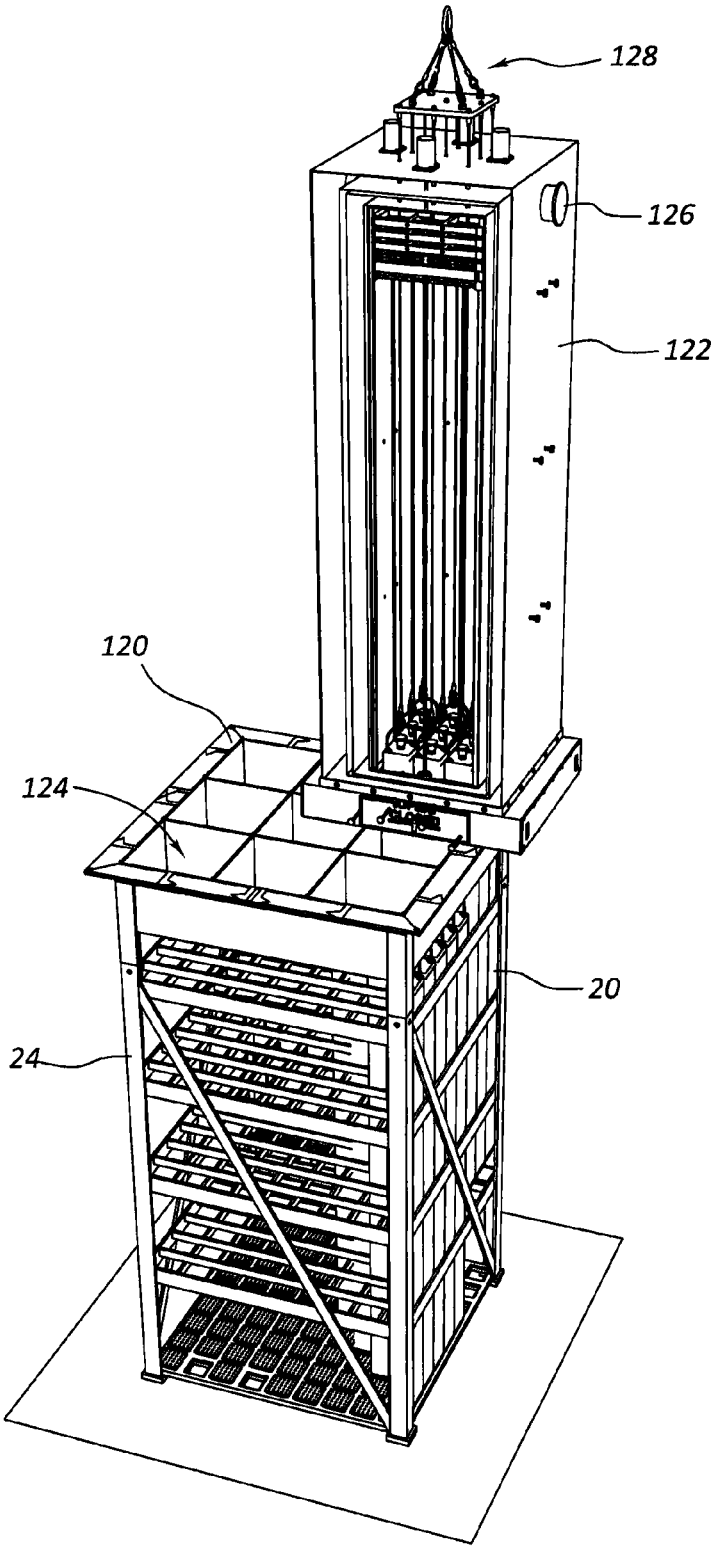
FIG. 21 shows the same view as FIG. 19 except a cross-sectional view of the transfer cask is provided to show what is happening inside as the canisters are lifted into the transfer cask.

FIGS. 19-21 show one embodiment of a process for moving the loaded canisters 20 from the pool to dry storage. The first step in the process is to place a transfer platform 120 on top of the staging rack 24 as shown in FIG. 19. The transfer platform 120 is configured to support a transfer cask 122 placed on top of the transfer platform 120. It should be appreciated that the transfer platform 120 is in the pool and all or a portion of the transfer cask 122 is also in the pool.

The transfer platform 120 is divided into nine sections 124, each of which corresponds to a group of canisters 20 in the staging rack 24 that will be loaded into the transfer cask 122. In the embodiment shown in FIG. 19, each section 124 corresponds to a 3×3 group of nine canisters 20. This is the number of canisters 20 that are loaded into the transfer cask 122.

In another embodiment, a 4×4 group of sixteen canisters 20 are loaded into the transfer cask 122. It should be appreciated that the transfer platform 120 and the transfer cask 122 can be configured to handle any number and/or size of canisters 20. For example, the transfer platform 120 and the transfer cask 122 can be configured to handle BWR or other types of spent fuel that have different shapes and cross-sectional sizes.

The transfer cask 122 can be formed of any material that is capable of providing the desired amount of structural strength and radiation shielding. In one embodiment, the transfer cask 122 is made of concrete, metal (e.g., stainless steel), or a combination of both. The transfer cask 122 includes trunnions 126 that are used to lift and handle the transfer cask 122. The trunnions are capable of supporting the weight of the loaded cask 122.

The canisters 20 are loaded into the transfer cask 122 as a group with a lifting assembly 128. The lifting assembly includes a lifting cable 130 and hook 132 for each of the canisters 20. The hooks 132 are configured to engage the lifting members 28 at the top of each canister 20. Once engaged, the lifting cables 130 lift the canisters 20 into the transfer cask 122. Alternatively, each canister 20 can be lifted separately into the transfer cask 122.

Figure 22:
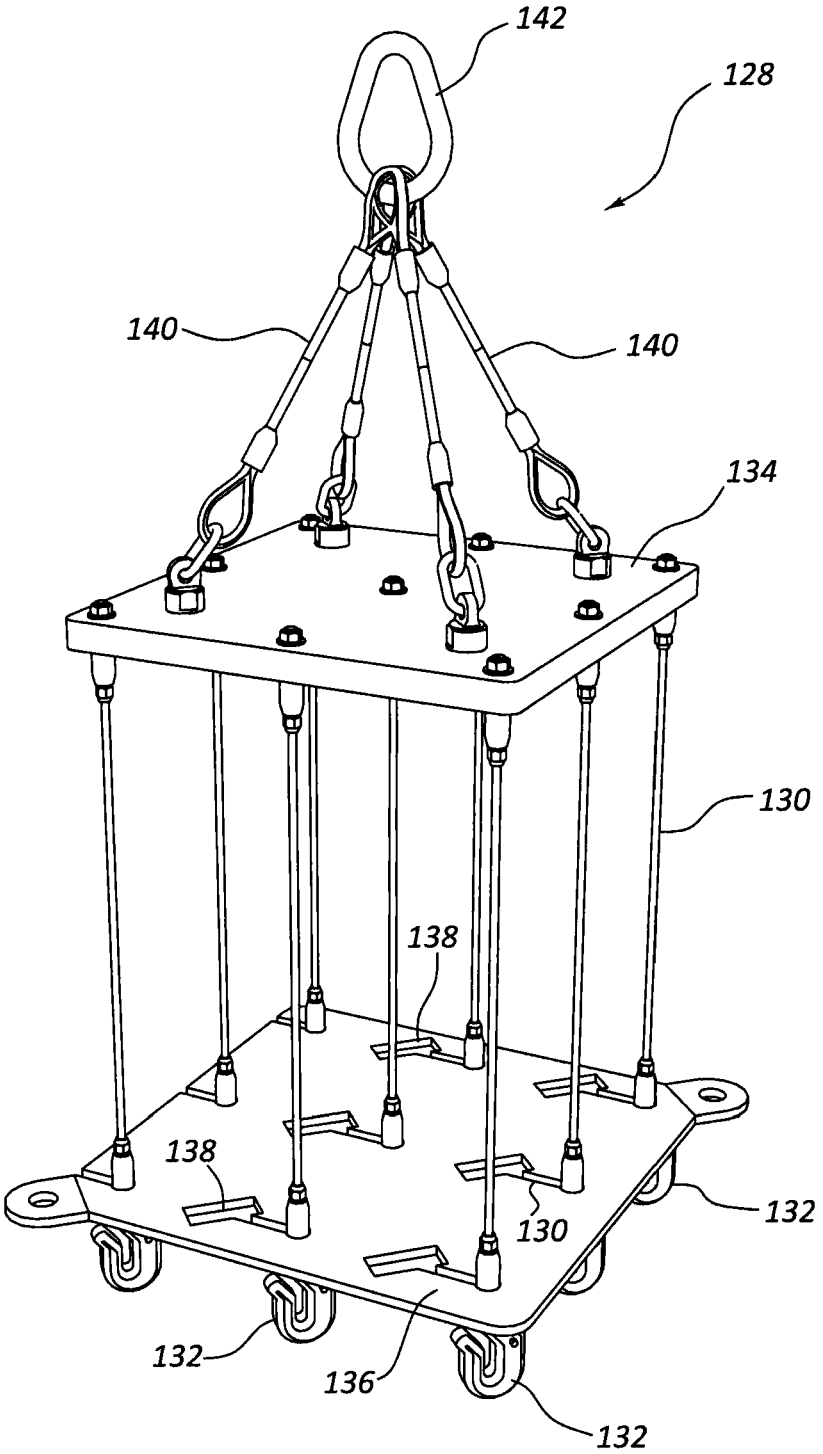
FIG. 22 shows one embodiment of a lifting assembly for lifting the canisters from the staging rack into the transfer cask.

FIG. 22 shows one embodiment of the lifting assembly 128 that includes a support member 134 (also referred to as a support plate), nine lifting cables 130 coupled to and extending downward from the support member 134, nine hooks 132 coupled to the end of the lifting cables 130 and an alignment member 136 (also referred to as an alignment plate) positioned just above the hooks 132. The alignment member 136 holds the lifting cables 130 and hooks 132 in a fixed spatial relationship to each other to make it easier for the hooks 132 to engage the lifting members 28 on the canisters 20.

The alignment member 136 includes slots 138 that engage a corresponding section on the hooks 132 to prevent the hooks 132 from rotating. The hooks 132 are configured to all face the same direction to make it easier to engage the lifting members 28. When the hooks 132 reach the lifting members 28, the lifting members 28 hit the underside of the hooks 132 and deflect the hooks 132 to one side until the lifting members 28 have cleared the opening of the hooks 132. At this point, the lifting members 28 move back the opposite direction until the open part of each hook 132 is directly below the corresponding lifting members 28. The hooks 132 are raised and engage the lifting members 28 and lift the canisters 20. It should be noted that the alignment member 136 causes the hooks 132 move as a single body and makes it impossible for them to twist or change the direction they face.

The lifting assembly 128 includes a plurality of cables 140 that extend from the top of the support member 134 upwards to a lifting ring 142. The support member 134 is configured to be positioned outside the transfer cask 122 while the alignment member 136 is positioned inside with the lifting cables 130 extending through openings in the top. A crane or other lifting device can be coupled to the lifting ring 142 to lift the canisters 20 into the transfer cask 122.

The opening on the underside of the transfer cask 122 through which the canisters 20 passed is closed before the transfer cask 122 is moved beyond the pool area. The exterior components of the lifting assembly 128 are kept inside the transfer cask 122 until it reaches its destination and the canisters 20 are placed in a storage cask and/or storage vault.

Figure 23:
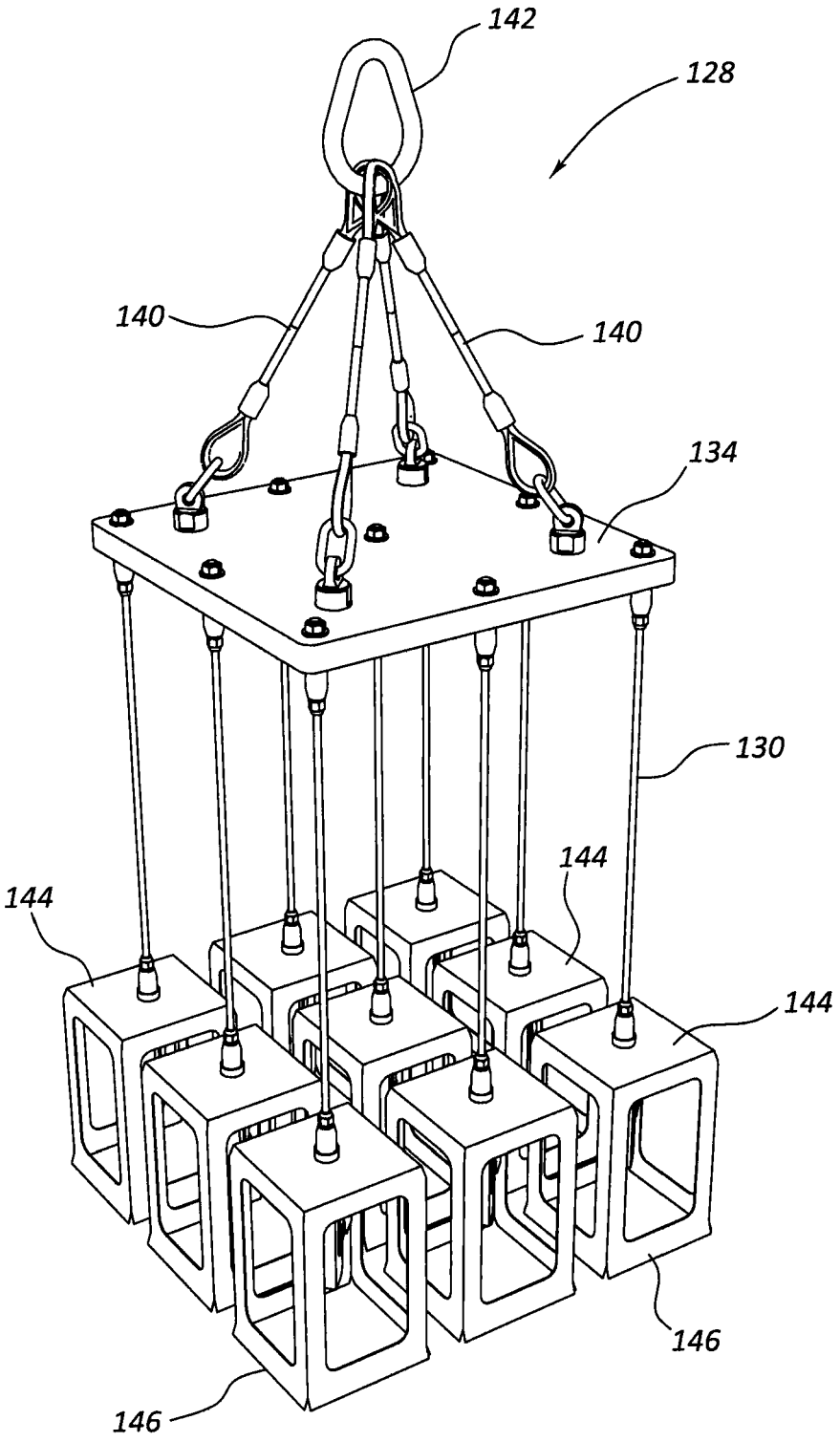
FIG. 23 shows another embodiment of a lifting assembly for lifting the canisters from the staging rack into the transfer cask.

FIG. 23 shows another embodiment of the lifting assembly 128. This embodiment is similar to the one shown in FIG. 22 except that the alignment member 136 has been replaced by a plurality of hook actuator assemblies 144. Each hook actuator assembly 144 includes a housing 146, a hook actuator 148, and a hook 132.

The housing 146 is sized to receive the lifting members 28 inside the housing 146 and to maintain the desired spacing between adjacent hook actuator assemblies 144. The size and configuration of the housing 146 can help maintain the hook actuator assemblies 144 in the proper orientation to allow them to drop down over the corresponding lifting members 28.

Figure 24:
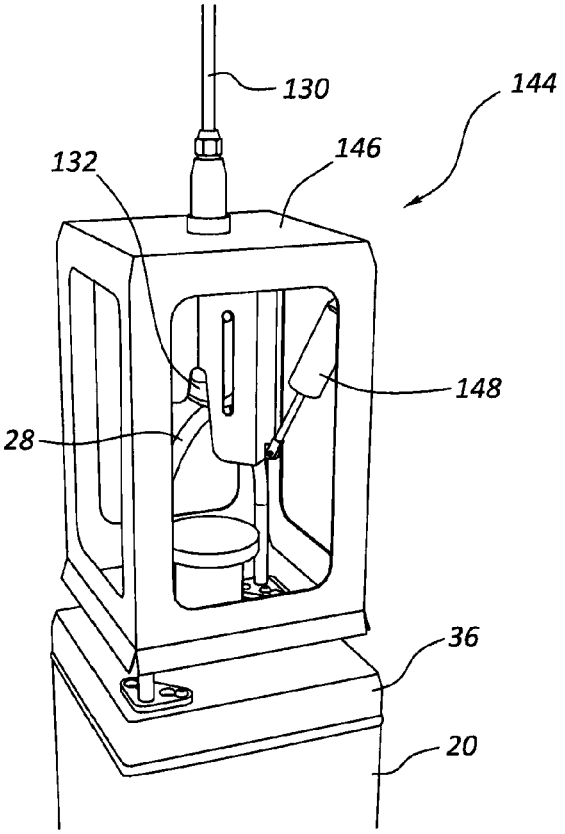
FIGS. 24-26 show the process used to get the hooks from the lifting assembly in FIG. 23 to engage the lifting members positioned at the top of the canisters.
Figure 25:
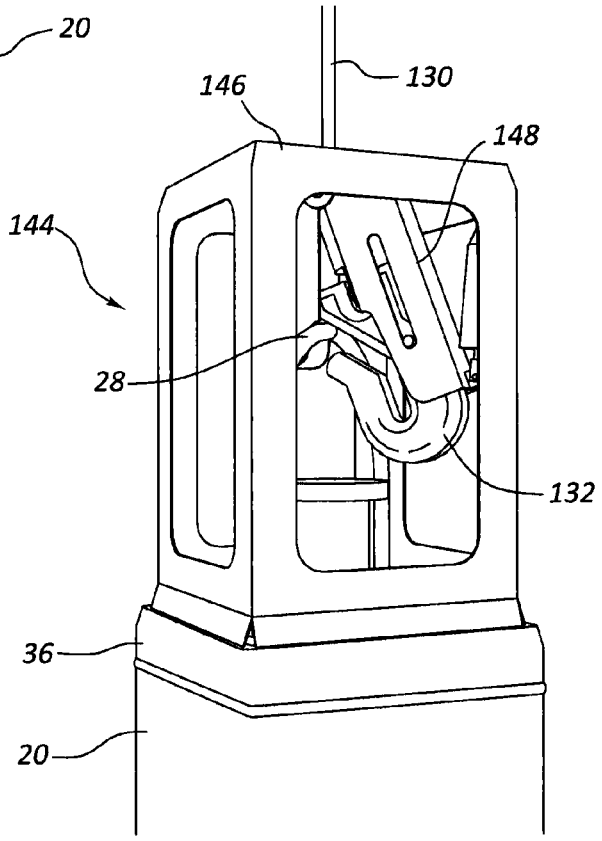
Figure 26:
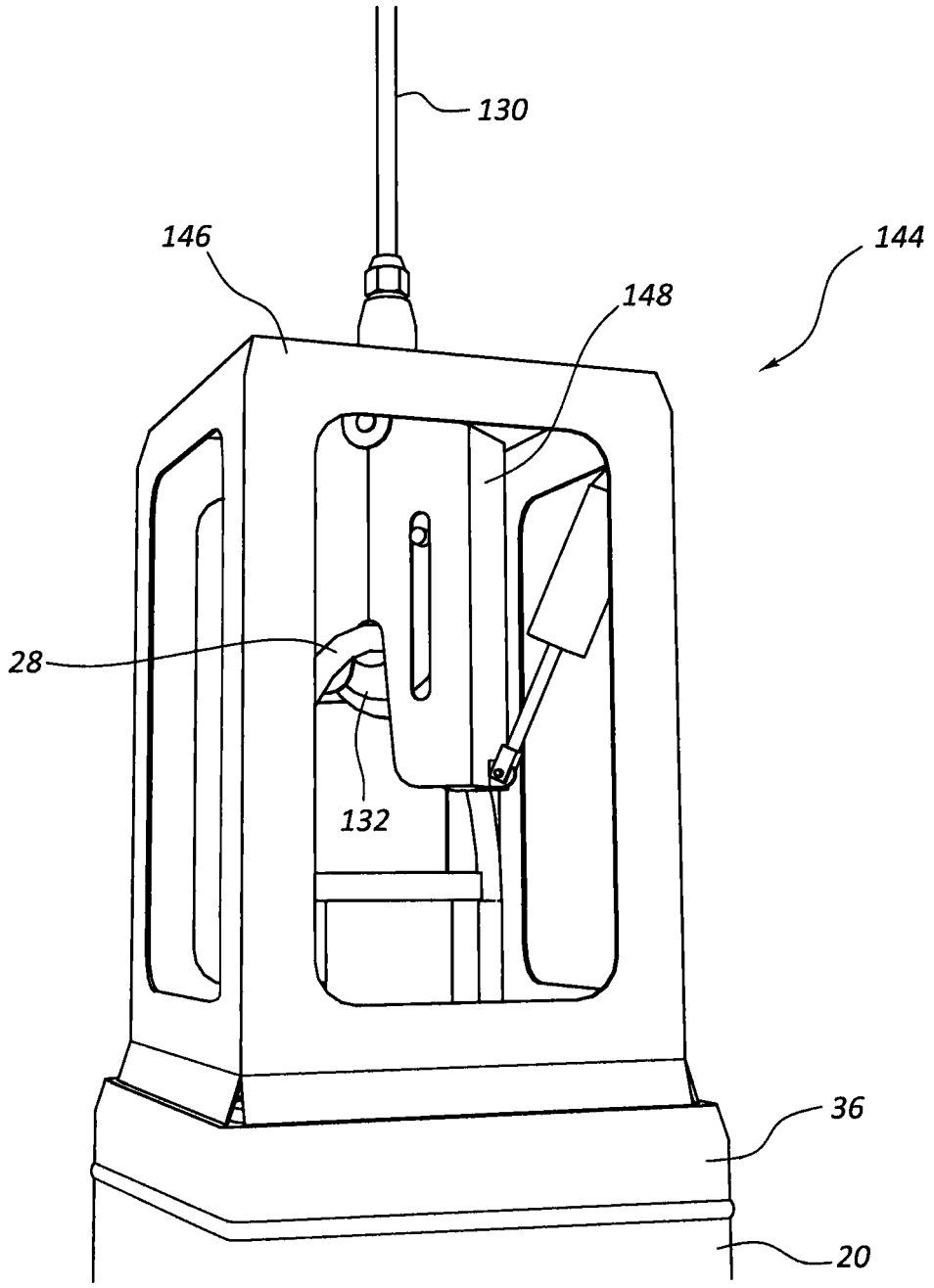

The operation of the hook actuator assemblies 144 is shown in FIGS. 24-26. The hook actuator assembly 144 is lowered until it reaches the lifting member 28 as shown in FIG. 24. The hook actuator 148 moves the hook 132 to a retracted position where the lifting member 28 can move past the hook 132 as shown in FIG. 25. The hook actuator assembly 144 is then lowered until the lifting member 28 is above the opening in the hook 132. The hook actuator 148 moves the hook 132 forward until the hook 132 securely engages the lifting member 28 as shown in FIG. 26. The canisters 20 are ready to be lifted into the transfer cask 122.

The hook actuator assemblies 144 can also be used to release the canisters 20 when they are lowered out of the transfer cask 122 and placed in a storage cask or the like. It should be appreciated that the hook actuators 148 can include any suitable hydraulic, electric, or pneumatic actuator. In one embodiment, the hook actuators 148 are operated electrically.

FIGS. 27-31 show one embodiment of a method to space the canisters 20 apart in the transfer cask 122. In this embodiment, the transfer cask 122 includes a plurality of spacers 150 that are actuated using a corresponding plurality of drive mechanisms 152. Each drive mechanism 152 includes a motor 154 drivingly connected to a screw 156.

The spacers 150 can be used to stabilize and hold the canisters 20 while the transfer cask 122 is in motion. The spacers 150 can also be used to provide criticality control by keeping the canisters 20 spaced apart from each other a safe distance.

The drive mechanisms 152 can also be configured to decontaminate and/or clean the exterior surface of the canisters 20. The contaminants accumulate on the exterior of the canisters 20 during storage in the pool. In one embodiment, the spacers 150 include cleaning equipment such as spray headers 158 and/or cleaning pads (e.g., Scotch-Brite cleaning pads). As the spacers 150 move up and down, the spray headers and cleaning pads move along the exterior of the canisters 20 to remove contaminants.

Figure 27:
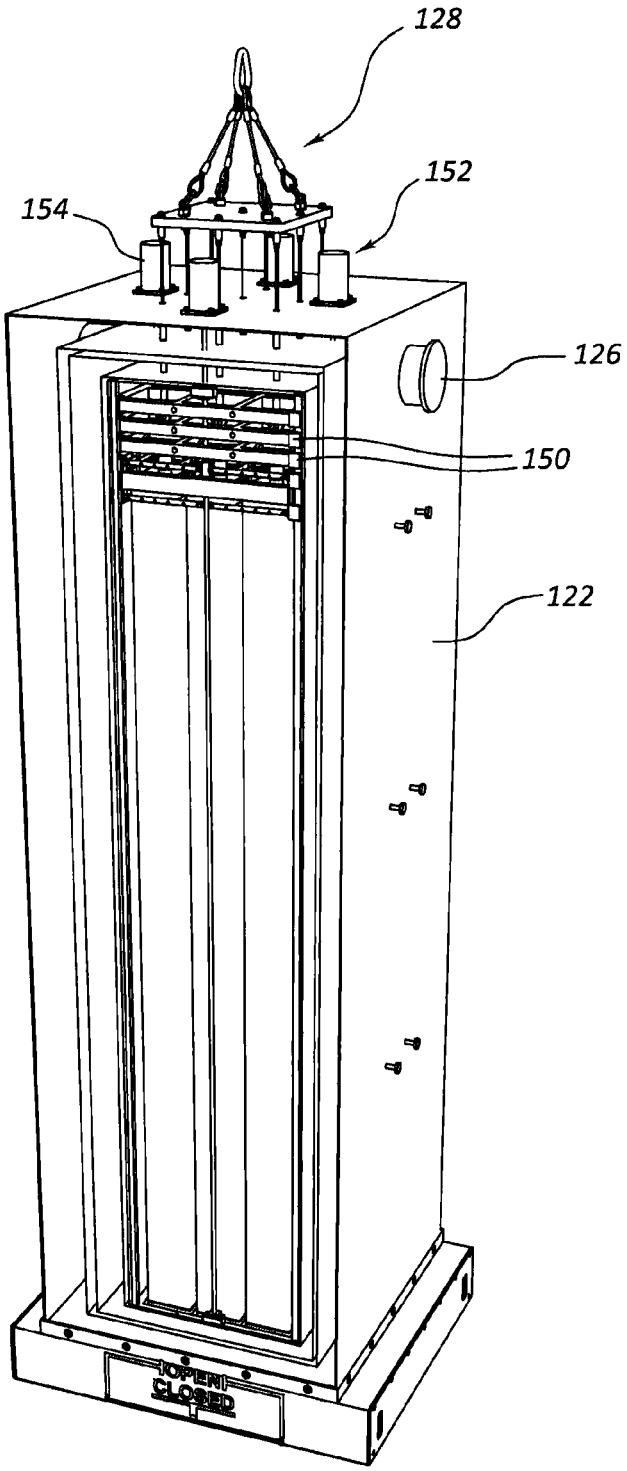
FIGS. 27-29 show one embodiment of system and method to space the canisters apart inside the transfer cask. The method includes a series of vertically adjustable spacers that can move downward around the canisters.
Figure 28:
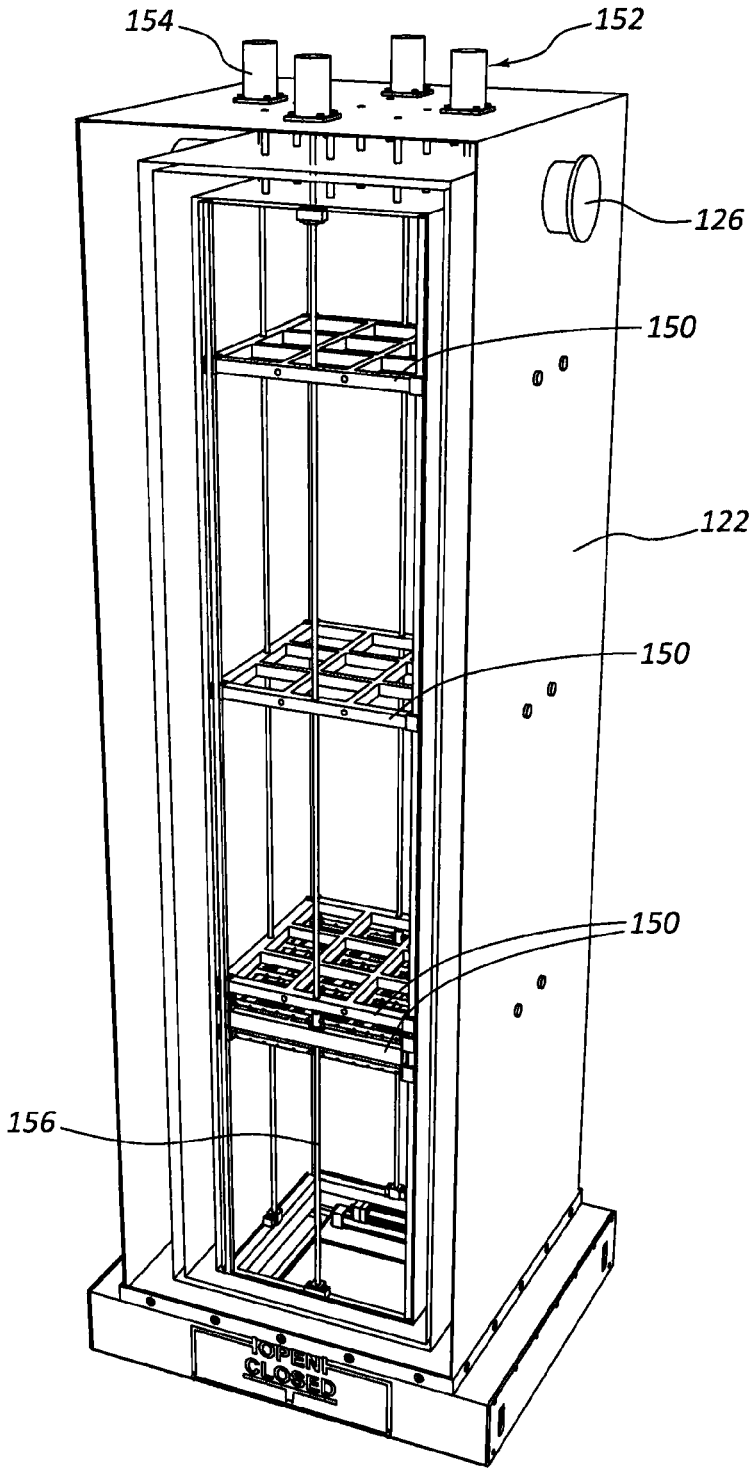
Figure 29:
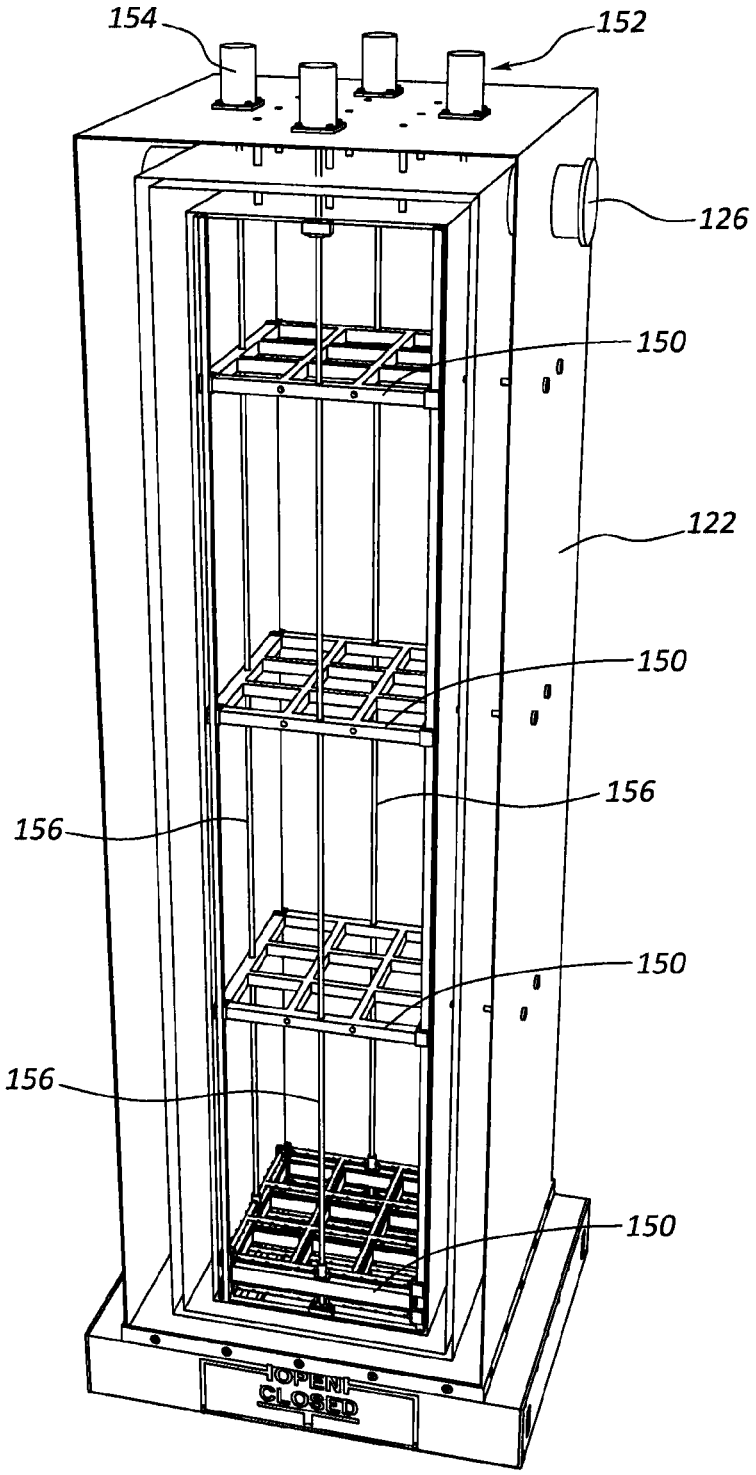

As shown in FIG. 27, the spacers 150 are raised while the transfer cask 122 is being loaded with canisters 20. This keeps the spacers 150 out of the way while the canisters 20 are raised from the staging rack 24. Once the canisters 20 are in the transfer cask 122, the spacers 150 are lowered to different heights using the drive mechanisms 152. The process of lowering the spacers 150 and the final heights of the spacers 150 are shown in FIGS. 27-29.

Figure 30:
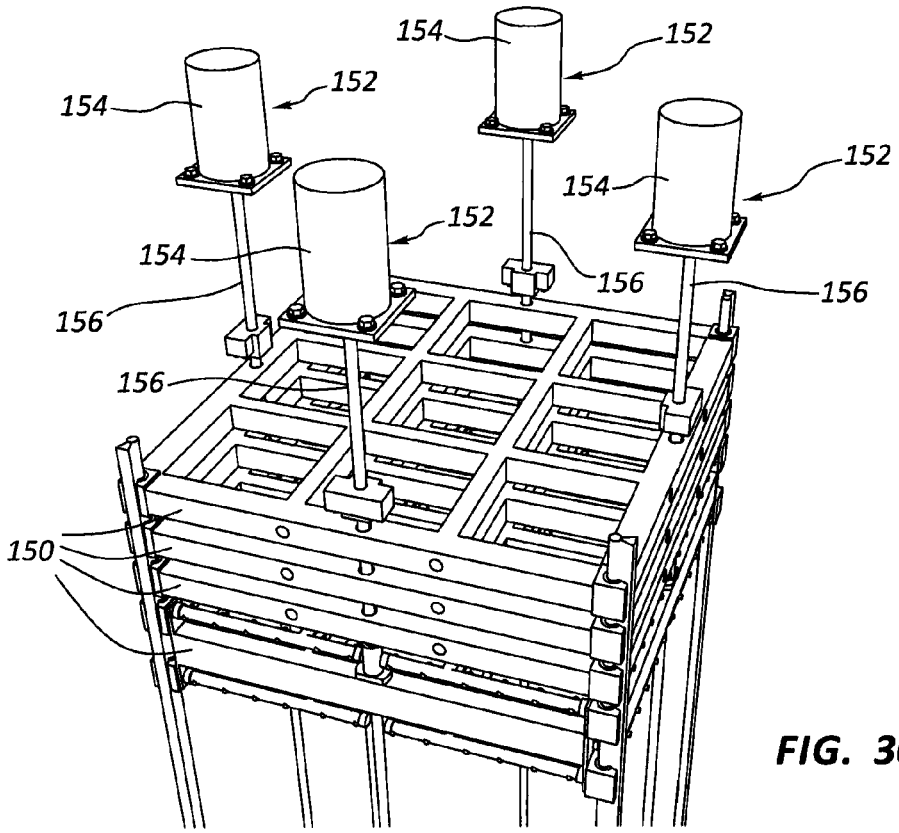
FIGS. 30-31 show perspective views of one embodiment of the vertically adjustable spacers in FIGS. 27-29.

FIG. 30 shows the spacers 150 and drive mechanisms 152 in greater detail. It should be appreciated that each screw 156 is configured to move a single spacer 150 even though the screw 156 is configured to extend through all four spacers 150. This is accomplished by configuring the screw 156 and spacers 150 so that the screw 156 only engages a single spacer 150 having a corresponding set of threads and passes freely through the other three spacers 150.

Figure 31:
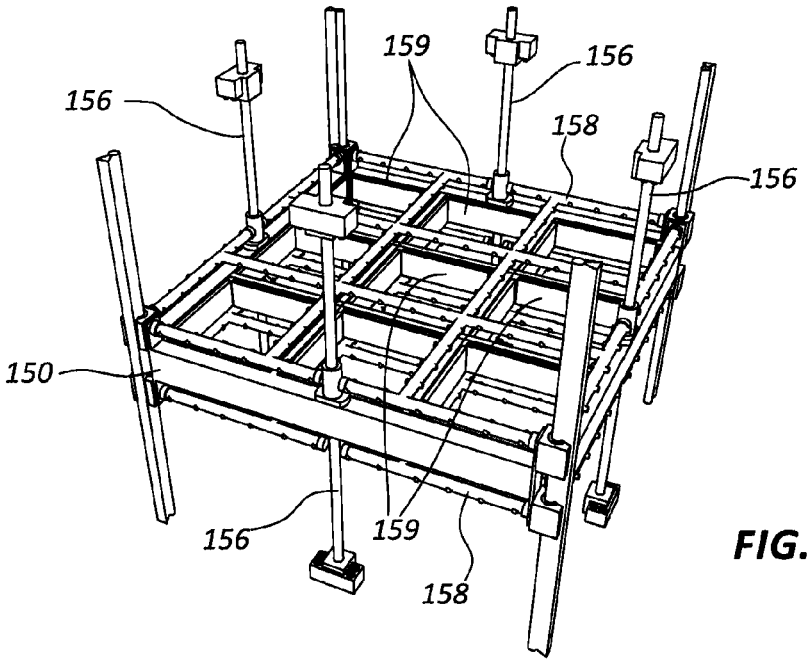

FIG. 31 shows that the bottom spacer 150 includes sprayers 158 and cleaning pads 159 that surround all of the canisters 20. As the bottom spacer 150 moves downward, the sprayers 158 and cleaning pads 159 remove contaminants on all sides of the canisters 20.

Figure 32:
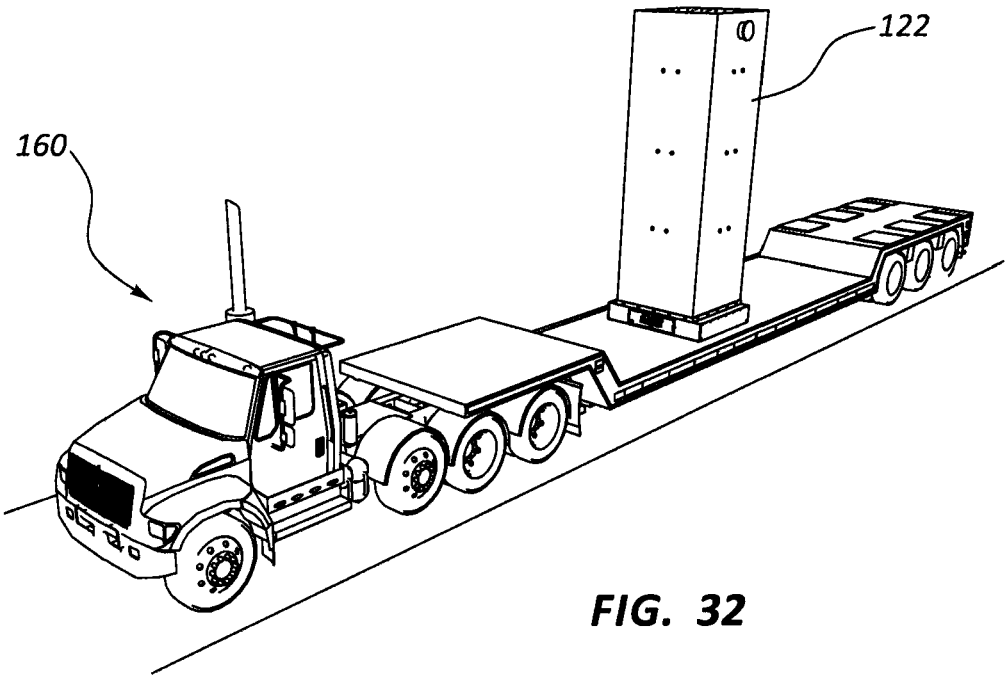
FIGS. 32-33 show perspective views of a truck and a cask transporter transporting the transfer cask to a dry storage site.
Figure 33:
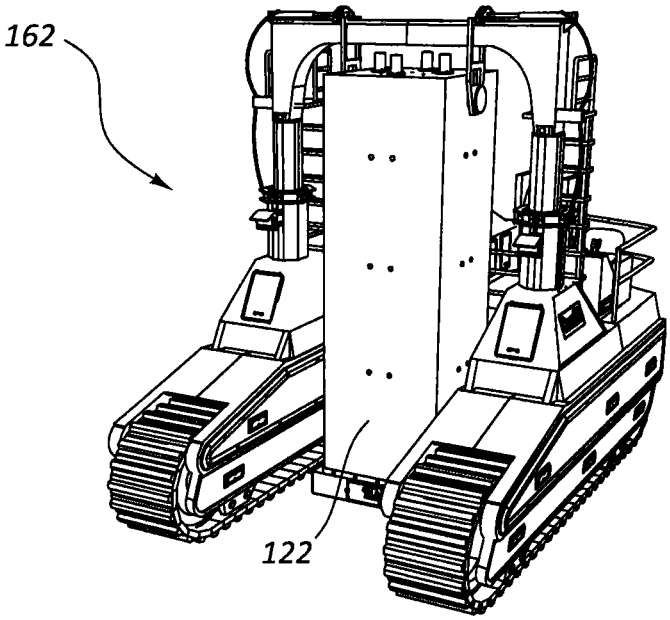

Turning to FIGS. 32-33, the transfer cask 122 can be moved from the pool to a dry storage area using a truck 160, cask transporter 162, or any other suitable mode of transportation. In one embodiment, the transfer cask 122 is moved to an independent spent fuel storage installation located on or near the reactor site and the canisters 20 are moved to dry storage.

FIGS. 34-38 show one embodiment of a dry storage system that includes a modular vault 200 that encloses one or more storage casks 202. The storage casks 202 are configured to receive the canisters 20 from the transfer cask 122.

Figure 34:
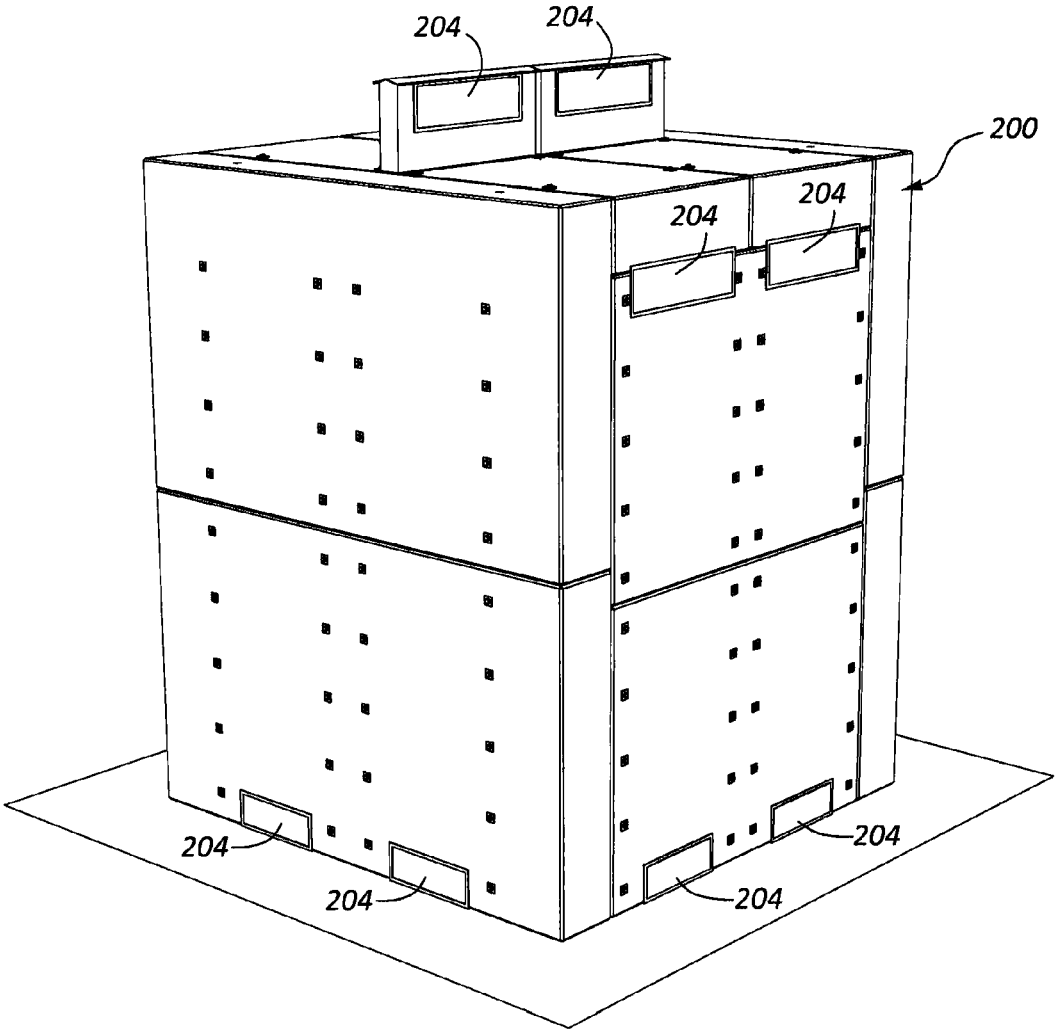
FIG. 34 shows a perspective view of a modular storage vault.
Figure 35:
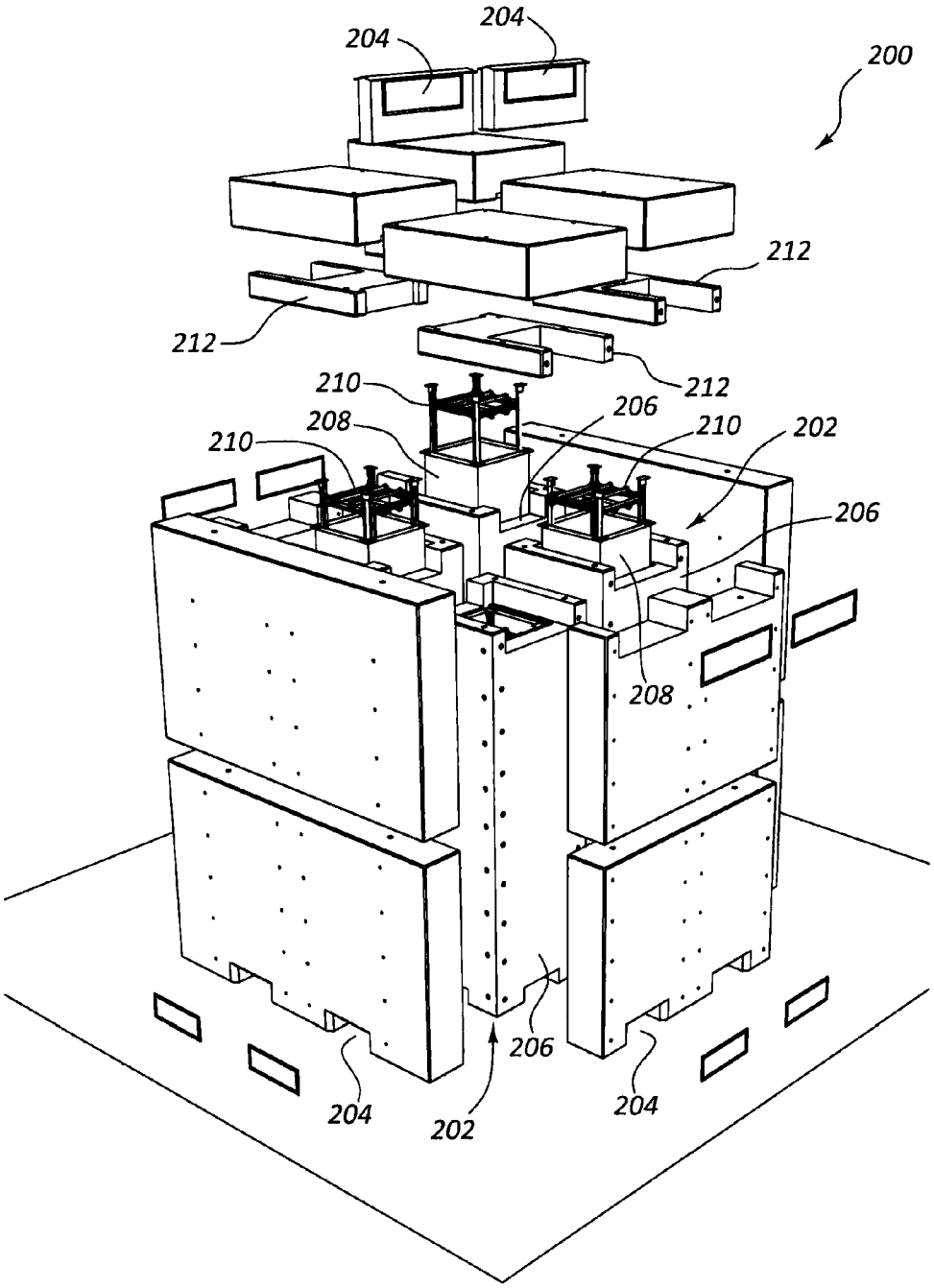
FIG. 35 shows an exploded perspective view of the modular storage vault in FIG. 34 filled with storage casks.

FIGS. 34-35 show a perspective view and an exploded view, respectively, of the modular vault 200. The vault 200 includes shielded openings 204 that allow passive ventilation by natural convection to dissipate the decay heat of the spent fuel. The air circulates from near ground level up through the interior of the vault 200 and escapes out the top. The circulating air passively cools the canisters 20 inside the vault 200.

Figure 38:
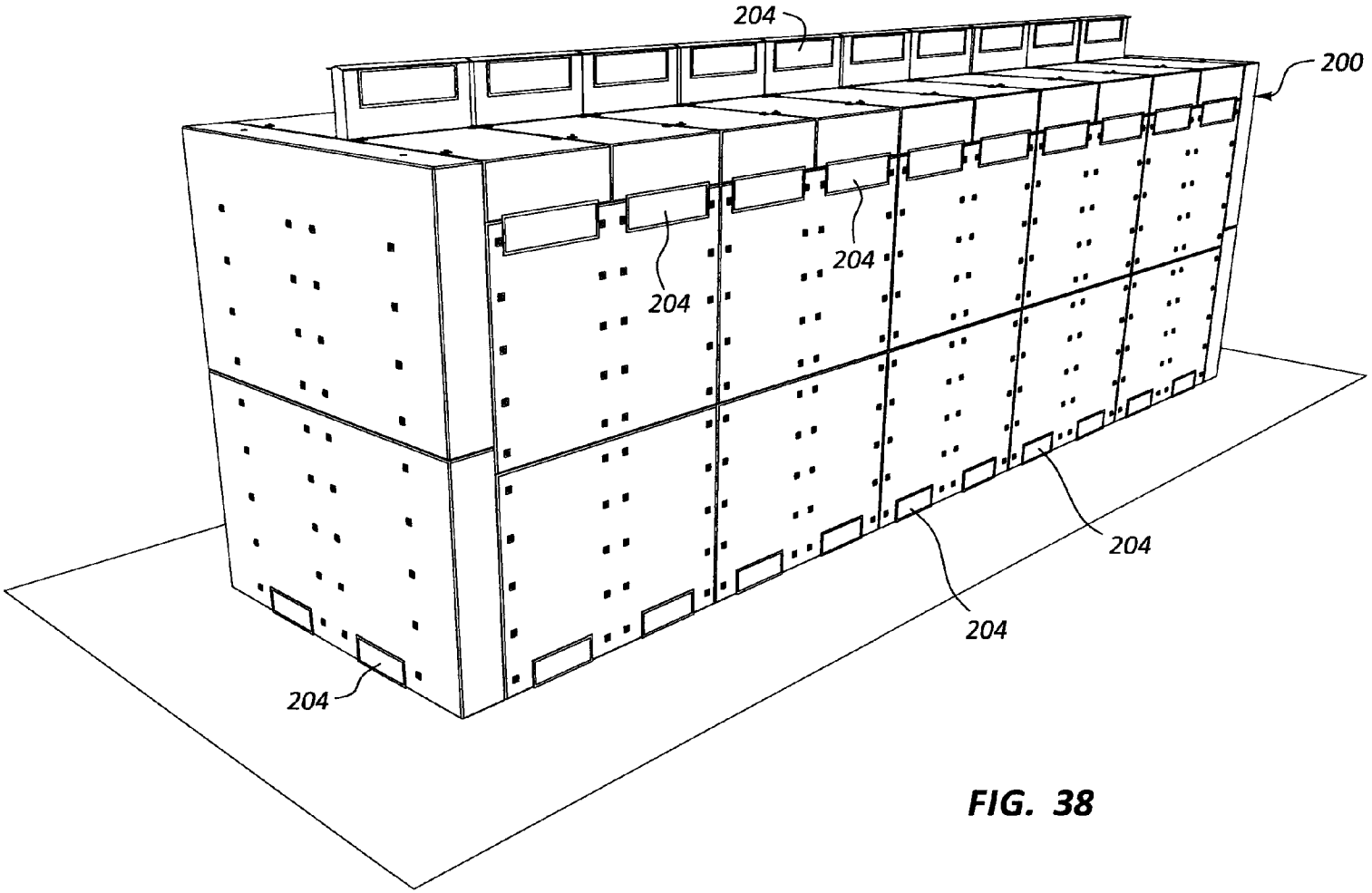
FIG. 38 shows the modular storage vault in FIG. 34 expanded to include additional space.

The vault 200 is modular in that it includes functionally separate expandable units configured to hold additional canisters 20. The vault 200 can be expanded on an as-needed basis so that capital improvement costs are spread out evenly over a longer time period. The savings reaped from minimizing idle vault capacity can be substantial depending on the facility and time span of the implementation. FIG. 38 shows one embodiment of the vault 200 after it has been expanded multiple times.

The vault 200 can be made of any suitable material that is capable of shielding the surrounding area from harmful radiation and providing passive cooling to the canisters 20. In one embodiment, the vault 200 is made of reinforced concrete. Such concrete components are sized to facilitate manufacture offsite and transport to the site for assembly. The concrete can be preformed panels that are coupled together on-site. The concrete can also be poured on-site. Preferably, preformed concrete is used so it can be easily disassembled to expand the vault 200.

Referring to FIG. 35, the vault 200 includes four storage casks 202. The storage casks 202 include a thick outer shell 206, a metal liner 208, an interior framework 210, and a lid or top 212. The shell 206 is made of a thick, solid material such as reinforced concrete that is capable of shielding harmful radiation.

Figure 36:
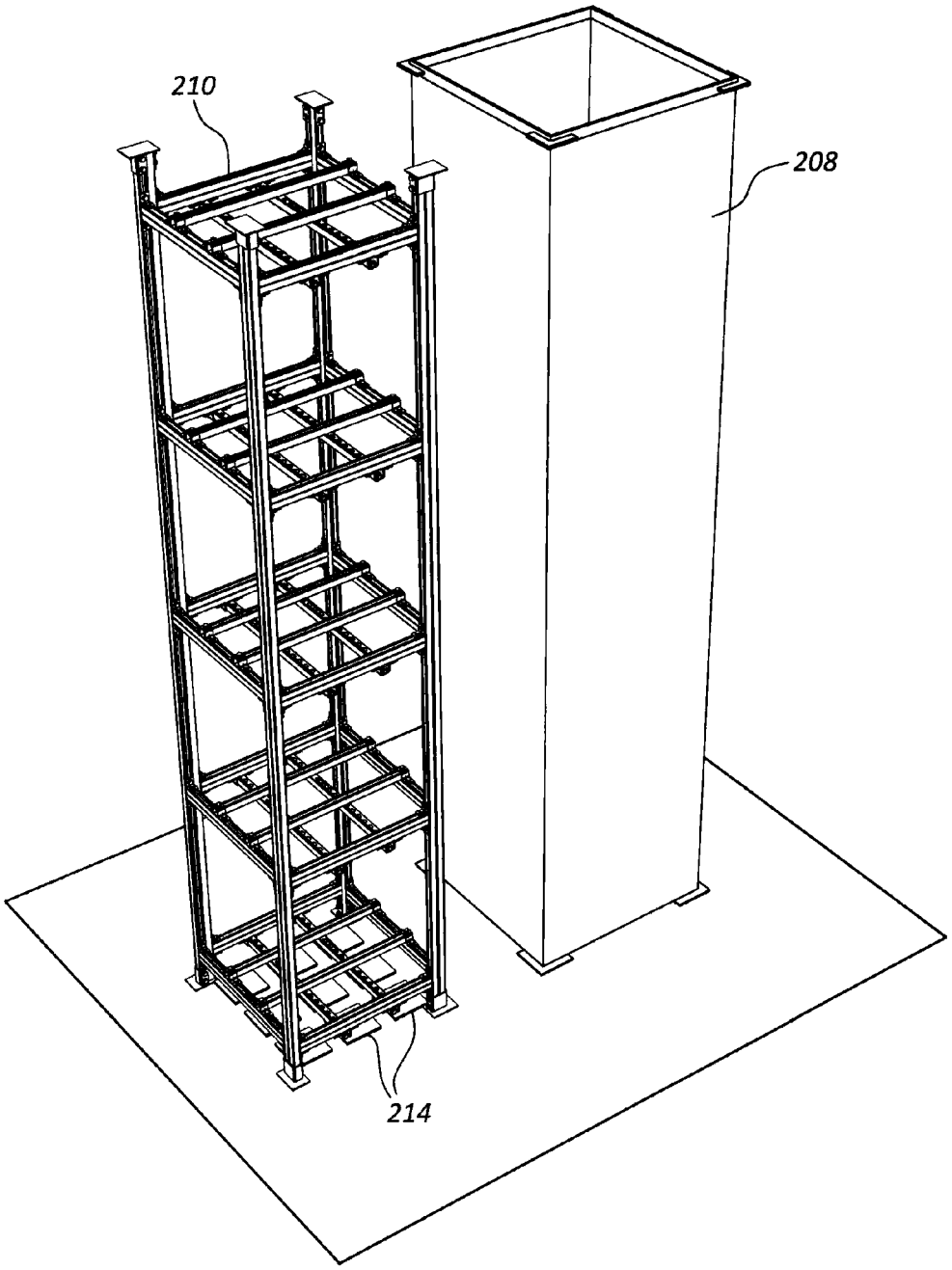
FIG. 36 shows an exploded perspective view of the storage cask in FIG. 35.

The metal liner 208 provides a thermal radiation shield to reduce concrete temperatures and a loose contamination barrier. The metal liner 208 is made of a corrosion resistant material such as stainless steel or galvanized steel. The interior framework 210 is likewise made of metal (e.g., stainless steel) and is configured to hold the canisters 20 in a spaced apart relationship that provides criticality control. Heat resistant ceramic plates 214 can be positioned at the bottom of each holding area in the framework 210 to minimize heat damage to the underlying material and to mitigate galvanic corrosion (FIG. 36). The lid 212 allows access to the top of the storage cask 202 for loading and unloading operations.

Figure 37:
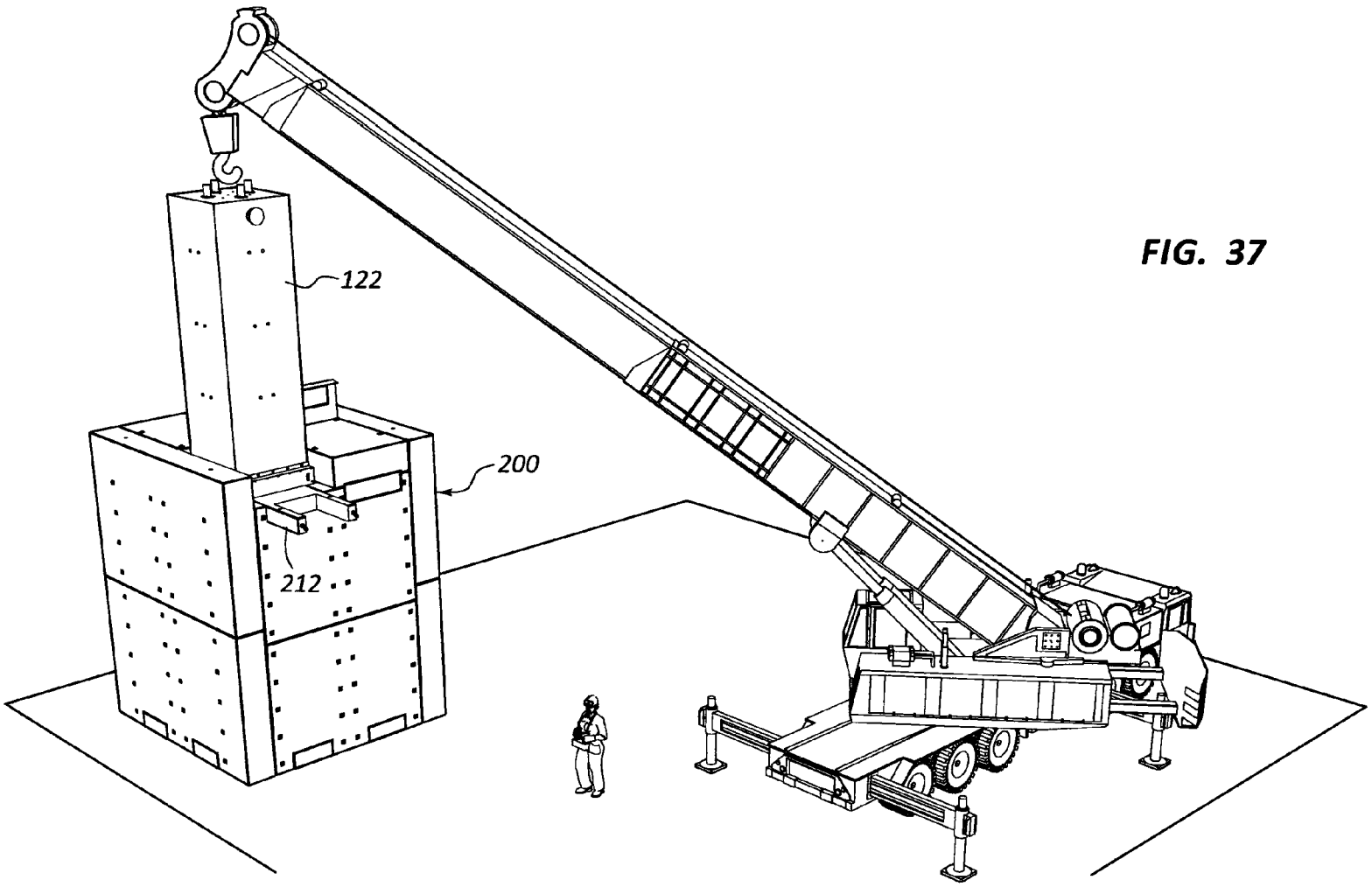
FIG. 37 shows a perspective view of the canisters being transferred from the transfer cask to the storage cask in the modular storage vault.

FIG. 37 shows the canisters 20 being moved from the transfer cask 122 and loaded into the storage cask 202. The first step is to remove the top panel of the modular vault 200 that covers the storage cask 202. The lid 212 of the storage cask 202 then slides outward to expose the interior framework 210 while maintaining radiation shielding. The transfer cask 122 is lifted over the storage cask 202 and the canisters 20 are aligned with the holding areas of the framework 210.

The canisters 20 are lowered into the storage cask 202 using the lifting assembly 128. The lifting assembly 128 disengages the canisters 20 in the manner described above and the lid 212 is moved back into place before the transfer cask 122 is moved away from the vault 200 to shield radiation. The lid 212 of the storage cask is put back into position and the top panel of the vault 200 is put in place. It should be noted that the aspect ratio and dimensions of the vault 200 are configured to provide a stable structure to resist earthquake loads without being anchored to the basemat.

It should be appreciated that one advantage of this system is the reduction of the need to handle bare spent fuel assemblies 22 for transfer operations between the different steps of spent fuel management. This reduces the potential for radiation exposure and human error. It also reduces the need for specialized transfer facilities and equipment and the concomitant safety risks and costs. It also eliminates the need to open, repackage, and rehandle the fuel as is currently the case with large conventional canisters. It also facilitates operations involved in the interface operations between different steps of the spent fuel management down to disposal, including safeguards inspections.

It should also be appreciated that the casks 122, 202 can be single-purpose, dual-purpose, or multi-purpose casks. For example, the cask 122 can be licensed as a multi-purpose cask so that the canisters 20 can be loaded into it once, stored, and disposed of without further handling.

Illustrative Embodiments

Reference is made in the following to a number of illustrative embodiments of the disclosed subject matter. The following embodiments illustrate only a few selected embodiments that may include one or more of the various features, characteristics, and advantages of the disclosed subject matter. Accordingly, the following embodiments should not be considered as being comprehensive of all of the possible embodiments.

In one embodiment, a method for enclosing a spent nuclear fuel rod assembly in an air tight canister comprises positioning a single spent nuclear fuel rod assembly in the canister and closing the canister to make it air tight. The canister is configured to only enclose the single spent nuclear fuel rod assembly.

Positioning the spent nuclear fuel rod assembly in the canister can include lowering the canister over the spent nuclear fuel rod assembly. Positioning the spent nuclear fuel rod assembly in the canister can take place in a pool. The method can comprise positioning the spent nuclear fuel rod assembly in a staging rack before positioning the spent nuclear fuel rod assembly in the canister.

The staging rack can include a plurality of holding areas each of which is configured to receive a spent nuclear fuel rod assembly. The staging rack can include a retaining member positioned at the bottom of each of the plurality of holding areas where the retaining members are configured to couple to the canister. Multiple storage racks can be used to store caniserized fuel in the pool or until removal to dry storage or transport.

The method can comprise coupling the canister to a retaining member positioned below the spent nuclear fuel rod assembly. The method can comprise lifting the canister with the spent nuclear fuel rod assembly in it out of a pool before closing the canister to make it air tight.

The method can comprise drying the interior of the canister and the spent nuclear fuel rod assembly. The method can comprise filling the canister with inert gas before closing the canister to make it air tight. Closing the canister can include welding a cover over any opening that provides access to the spent nuclear fuel rod assembly in the interior of the canister.

The method can comprise positioning the spent nuclear fuel rod assembly in a staging rack after closing the canister to make it air tight. The staging rack can be in a pool. The method can comprise positioning a plurality of the canisters in a cask. The method can comprise positioning a plurality of the casks in a storage vault.

In another embodiment, a canister for enclosing a spent nuclear fuel rod assembly comprises a single spent nuclear fuel rod assembly positioned in the canister. The canister can enclose the spent nuclear fuel rod assembly. The canister can be air tight.

The spent nuclear fuel rod assembly can be enclosed in a gaseous atmosphere. The spent nuclear fuel rod assembly can be enclosed in an inert atmosphere. The spent nuclear fuel rod assembly can include a framework and a plurality of spent nuclear fuel rods held together in a fixed spatial relationship to each other by the framework.

The interior of the canister can have the same general shape as the exterior of the spent nuclear fuel rod assembly. The canister can comprise a lifting member at the top of the canister. The canister can comprise a coupler that provides a passageway into the canister to the spent nuclear fuel rod assembly and a cap member that covers the coupler and prevents gas from escaping from the canister. The coupler can be configured to connect to a source of compressed gas.

The canister can comprise a tubular member having an elongated shape and a top and a bottom, a first end cover coupled to the top of the tubular member, and a second end cover coupled to the bottom of the tubular member. The interior of the tubular member can have the same general shape as the exterior of the spent nuclear fuel rod assembly.

The canister can comprise a top, a bottom, and a retaining member. The retaining member can be located at the bottom of the canister and can support the spent nuclear fuel rod assembly. The retaining member can include openings through which water can flow.

In another embodiment, a system comprises a staging rack and the canister positioned in the staging rack. The staging rack can be positioned in a pool. A system can comprise a cask and a plurality of the canisters recited in claim INDEP positioned in the cask. The cask can include at least three of the canisters. A system can comprise a storage vault and a plurality of the casks positioned in the storage vault. The storage vault can be modular.

The concepts and aspects of one embodiment may apply equally to one or more other embodiments or may be used in combination with any of the concepts and aspects from the other embodiments. Any combination of any of the disclosed subject matter is contemplated.

The terms recited in the claims should be given their ordinary and customary meaning as determined by reference to relevant entries in widely used general dictionaries and/or relevant technical dictionaries, commonly understood meanings by those in the art, etc., with the understanding that the broadest meaning imparted by any one or combination of these sources should be given to the claim terms (e.g., two or more relevant dictionary entries should be combined to provide the broadest meaning of the combination of entries, etc.) subject only to the following exceptions: (a) if a term is used in a manner that is more expansive than its ordinary and customary meaning, the term should be given its ordinary and customary meaning plus the additional expansive meaning, or (b) if a term has been explicitly defined to have a different meaning by reciting the term followed by the phrase "as used herein shall mean" or similar language (e.g., "herein this term means," "as defined herein," "for the purposes of this disclosure the term shall mean," etc.).

References to specific examples, use of "i.e.," use of the word "invention," etc., are not meant to invoke exception (b) or otherwise restrict the scope of the recited claim terms. Other than situations where exception (b) applies, nothing contained herein should be considered a disclaimer or disavowal of claim scope.

The subject matter recited in the claims is not coextensive with and should not be interpreted to be coextensive with any particular embodiment, feature, or combination of features shown herein. This is true even if only a single embodiment of the particular feature or combination of features is illustrated and described herein. Thus, the appended claims should be given their broadest interpretation in view of the prior art and the meaning of the claim terms.

As used herein, spatial or directional terms, such as "left," "right," "front," "back," and the like, relate to the subject matter as it is shown in the drawings. However, it is to be understood that the described subject matter may assume various alternative orientations and, accordingly, such terms are not to be considered as limiting.

Articles such as "the," "a," and "an" can connote the singular or plural. Also, the word "or" when used without a preceding "either" (or other similar language indicating that "or" is unequivocally meant to be exclusive—e.g., only one of x or y, etc.) shall be interpreted to be inclusive (e.g., "x or y" means one or both x or y).

The term "and/or" shall also be interpreted to be inclusive (e.g., "x and/or y" means one or both x or y). In situations where "and/or" or "or" are used as a conjunction for a group of three or more items, the group should be interpreted to include one item alone, all of the items together, or any combination or number of the items. Moreover, terms used in the specification and claims such as have, having, include, and including should be construed to be synonymous with the terms comprise and comprising.

Unless otherwise indicated, all numbers or expressions, such as those expressing dimensions, physical characteristics, etc. used in the specification (other than the claims) are understood as modified in all instances by the term "approximately." At the very least, and not as an attempt to limit the application of the doctrine of equivalents to the claims, each numerical parameter recited in the specification or claims which is modified by the term "approximately" should at least be construed in light of the number of recited significant digits and by applying ordinary rounding techniques.

All ranges disclosed herein are to be understood to encompass and provide support for claims that recite any and all subranges or any and all individual values subsumed therein. For example, a stated range of 1 to 10 should be considered to include and provide support for claims that recite any and all subranges or individual values that are between and/or inclusive of the minimum value of 1 and the maximum value of 10; that is, all subranges beginning with a minimum value of 1 or more and ending with a maximum value of 10 or less (e.g., 5.5 to 10, 2.34 to 3.56, and so forth) or any values from 1 to 10 (e.g., 3, 5.8, 9.9994, and so forth).

What is claimed is:

1. A method for enclosing a single spent nuclear fuel rod assembly in an air tight canister comprising:

positioning a spent nuclear fuel rod assembly in a staging rack in a pool;

positioning the single spent nuclear fuel rod assembly in the canister in the pool including lowering the canister over the spent nuclear fuel rod assembly while the spent nuclear fuel rod assembly is in the staging rack;

moving the canister out of the pool and draining the water inside the canister;

drying the interior of the canister and the spent nuclear fuel rod assembly while the canister is out of the pool;

closing the canister to make it air tight including welding shut any openings that provide access to the spent nuclear fuel rod assembly in the interior of the canister while the canister is out of the pool; and moving the closed canister back into the staging rack in the pool;

wherein the canister only encloses the single spent nuclear fuel rod assembly.

2. The method of claim 1 wherein the staging rack includes a plurality of holding areas each of which is configured to receive a spent nuclear fuel rod assembly.

3. The method of claim 2 wherein the staging rack includes a retaining member positioned at the bottom of each of the plurality of holding areas, the retaining members being configured to couple to the canister.

4. The method of claim 1 comprising filling the canister with inert gas before closing the canister to make it air tight.

5. The method of claim 1 comprising positioning a plurality of the canisters in a cask.

6. The method of claim 1 wherein moving the canister out of the pool includes lifting the canister into a shielded chamber where the interior of the canister is dried and any openings are welded shut.

* * * * *